US010061260B2

(12) United States Patent
Sakamoto et al.

(10) Patent No.: US 10,061,260 B2
(45) Date of Patent: Aug. 28, 2018

(54) IMAGE FORMING APPARATUS AND DRAWER MEMBER

(71) Applicant: CANON KABUSHIKI KAISHA, Tokyo (JP)

(72) Inventors: Takahiro Sakamoto, Suntou-gun (JP); Yuichi Sakakibara, Fuchu (JP); Tsutomu Nishiuwatoko, Numazu (JP); Takashi Akutsu, Odawara (JP); Daisuke Abe, Suntou-gun (JP); Ken Kikuchi, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/410,286

(22) Filed: Jan. 19, 2017

(65) Prior Publication Data

US 2017/0131678 A1 May 11, 2017

Related U.S. Application Data

(63) Continuation of application No. 15/061,141, filed on Mar. 4, 2016, now Pat. No. 9,606,501.

(30) Foreign Application Priority Data

Mar. 5, 2015 (JP) ..... 2015-043164

(51) Int. Cl.
*G03G 21/16* (2006.01)

(52) U.S. Cl.
CPC ..... *G03G 21/1609* (2013.01)

(58) Field of Classification Search
CPC ..... G03G 21/1832; G03G 21/1842
(Continued)

(56) References Cited

U.S. PATENT DOCUMENTS 7,203,444 B2 4/2007 Yamazaki
7,352,377 B2 4/2008 Matsutomo
(Continued)

FOREIGN PATENT DOCUMENTS

JP 06202393 A 7/1994
JP 09244362 A 9/1997
(Continued)

OTHER PUBLICATIONS

Notice of Allowance issued in U.S. Appl. No. 15/061,141 dated Oct. 19, 2016.

*Primary Examiner* — David M Gray
*Assistant Examiner* — Andrew V Do
(74) *Attorney, Agent, or Firm* — Rossi, Kimms & McDowell LLP

(57) ABSTRACT

An image forming apparatus includes a main assembly provided with an opening; a drawer movable while supporting an cartridge including a photosensitive drum between an inside position and an outside position; an optical unit in the main assembly to project light onto the drum a shutter member provided in the main assembly and movable between a closing position and an open position an operating portion to move the shutter member from the open position to the closing position in a process of movement of the drawer from the inside position to the outside position and to move the shutter member from the closing position to the open position in a process of movement of the drawer from the outside position to the inside position.

31 Claims, 27 Drawing Sheets

(58) Field of Classification Search
USPC ..... 399/110
See application file for complete search history.

(56) References Cited

U.S. PATENT DOCUMENTS

| | | | |
|---|---|---|---|
| 7,486,907 | B2 | 2/2009 | Noguchi et al. |
| 8,203,586 | B2 | 6/2012 | Kaneko et al. |
| 8,918,009 | B2 | 12/2014 | Lee et al. |
| 9,134,690 | B2 | 9/2015 | Kato et al. |
| 9,188,949 | B2 | 11/2015 | Sato et al. |
| 9,423,763 | B2 | 8/2016 | Souda |
| 2006/0140673 | A1 | 6/2006 | Kamimura et al. |
| 2008/0219696 | A1 | 9/2008 | Itabashi |
| 2008/0286001 | A1 | 11/2008 | Matsumoto et al. |
| 2009/0269102 | A1* | 10/2009 | Kaneko ..... G03G 15/04072 399/123 |
| 2010/0054800 | A1 | 3/2010 | Okabe |
| 2012/0183322 | A1 | 7/2012 | Sato et al. |

FOREIGN PATENT DOCUMENTS

| | | | |
|---|---|---|---|
| JP | 2004333799 | A | 11/2004 |
| JP | 2009288310 | A | 12/2009 |
| JP | 2011059730 | A | 3/2011 |
| JP | 2013228635 | A | 11/2013 |
| JP | 2014126829 | A | 7/2014 |

* cited by examiner

FIG. 19(a)
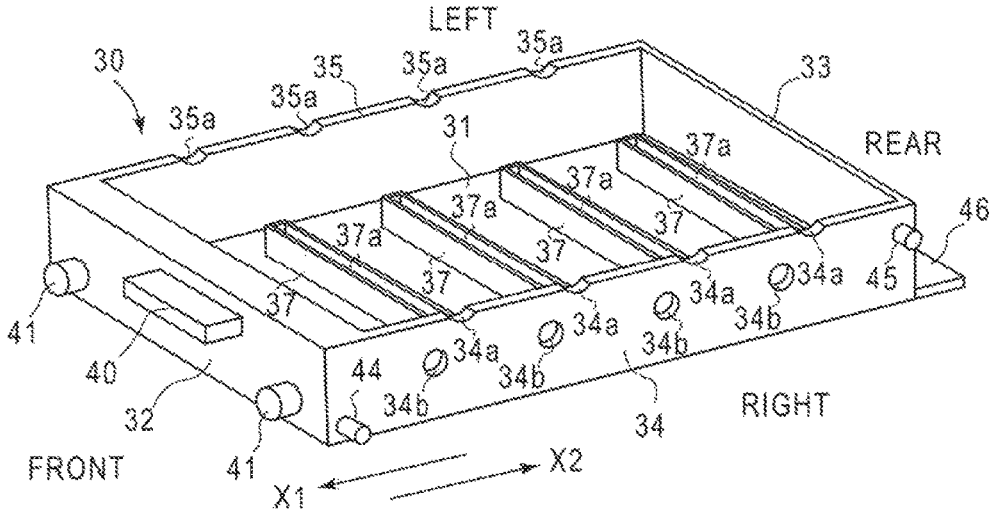
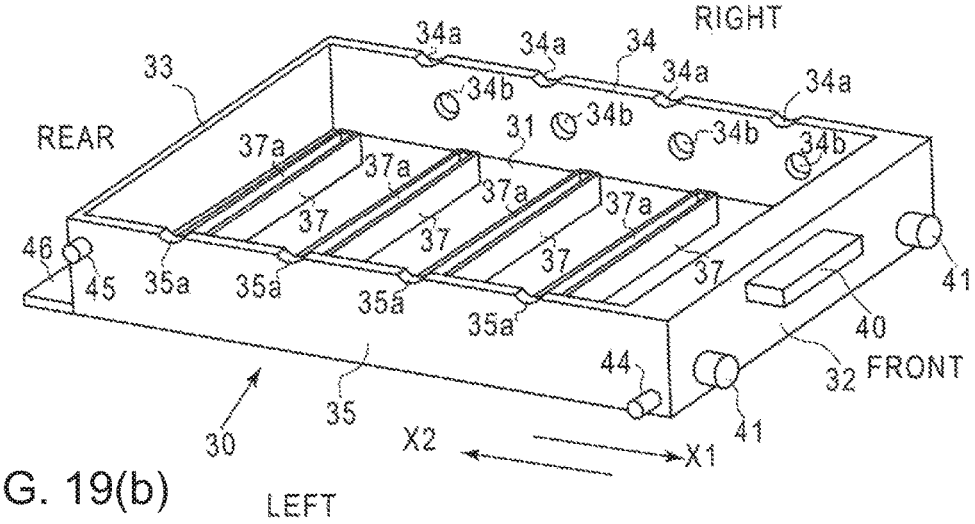
FIG. 19(b)

IMAGE FORMING APPARATUS AND DRAWER MEMBER

FIELD OF THE INVENTION AND RELATED ART

The present invention relates to an image forming apparatus for forming an image on a recording material and to a drawer member usable with a main assembly of the image forming apparatus.

Generally, an electrophotographic image forming apparatus in which a photosensitive drum as an image bearing member is exposed to a laser beam is provided with a shutter member capable of opening and closing a laser beam path in order to reduce contamination of an optical unit (exposure device) due to dust and/or toner falling.

Some of the shutter members is opened and closed in interrelation with mounting and demounting of a process cartridge including the photosensitive drum or an opening and closing operation of an outer casing of the image forming apparatus (Japanese Laid-open Patent Application 2009-288310, Japanese Laid-open Patent Application Hei 6-202393). More particularly, the shutter member is open when the image forming operation of the image forming apparatus is enabled. The shutter is closed when the user or service person mounts or dismounts process cartridge or when the outer casing is opened for the purpose of clearing jammed sheet, for example, so that the contamination of the optical unit due to the dust and/or the toner falling or the like is reduced.

However, employing the mechanism for opening and closing the shutter member in interrelation with the mounting and demounting operation of the process cartridge requires the provision of a contacting mechanism so that the process cartridge contacts to the shutter member or a member linked with the shutter member. Therefore, when the user mounts the process cartridge, the contacting mechanism more or less impedes with the result of deterioration of the operationality.

In the image forming apparatus of the type in which the process cartridge is mounted on the drawer member, which is slid into the main assembly of the apparatus, a mechanism for opening and closing of the shutter member in interrelation with the opening and closing operation of the outer casing is ordinarily used.

However, with such a mechanism, members for permitting access to the exposure windows are required with the result of complication of the structure of the image forming apparatus.

SUMMARY OF THE INVENTION

Accordingly, it is a object of the present invention to provide a image forming apparatus of the type in which the cartridge is mounted to the main assembly by sliding the drawer member carrying the cartridge comprising a simple and easy opening and closing mechanism for the shutter member to reduce the contamination of the optical unit.

According to an aspect of the present invention, there is provided an image forming apparatus for forming an image on a recording material, said apparatus comprising a main assembly provided with an opening; a drawer member movable relative to said main assembly while supporting an image forming portion including at least an image bearing member for carrying a toner image, between an inside position which is inside said main assembly and in which a image forming operation is enabled and an outside position to which said drawer member is drawn out of said main assembly through said opening and in which a cartridge including at least a part of said image forming portion is mountable to and dismountable from said drawer member; an optical unit provided in said main assembly and configured to project light onto said image bearing member; a shutter member provided in said main assembly and movable between a closing position for closing an optical path for the light to be projected onto said image bearing member from said optical unit and an open position for opening the optical path; and an operating portion configured to move said shutter member from the open position to the closing position in a process of movement of said drawer member from the inside position to the outside position and configured to move said shutter member from the closing position to the open position in a process of movement of said drawer member from the outside position to the inside position.

According to another aspect of the present invention, there is provided a drawer member usable with a main assembly of a image forming apparatus, the main assembly including an opening, an optical unit configured to project light onto an image bearing member for carrying a toner image, and a shutter member movable between a closing position for closing an optical path for the light to be projected onto the image bearing member and an open position for opening the optical path, wherein a drawer member is movable relative to said main assembly while supporting an image forming portion including at least an image bearing member, between an inside position which is inside said main assembly and in which a image forming operation is enabled and an outside position to which said drawer member is drawn out of said main assembly through said opening and in which a cartridge including at least a part of said image forming portion is mountable to and dismountable from said drawer member, said drawer member comprising an engaging portion engageable with a portion-to-be-engaged provided on a side of said shutter member, wherein said engaging portion moves said shutter member from the open position to the closing position in a process of movement of said drawer member from the inside position to the outside position and moves said shutter member from the closing position to the open position in a process of movement of said drawer member from the outside position to the inside position.

Further features of the present invention will become apparent from the following description of exemplary embodiments with reference to the attached drawings.

BRIEF DESCRIPTION OF THE DRAWINGS

FIGS. 19(*a*) and 19(*b*) are perspective views of the outer appearance of the drawer member in Embodiment 4.

DESCRIPTION OF THE EMBODIMENTS

The embodiments of the present invention will be described in conjunction with the accompanying drawings. The preferred embodiments of the present invention will be described in conjunction with the accompanying drawings. Here, the dimensions, the sizes, the materials, the configurations, the relative positional relationships of the elements in the following embodiments and examples are not restrictive to the present invention unless otherwise stated.

Embodiment 1

[General Arrangement of an Example of Image Forming Apparatus]

Figure 1:
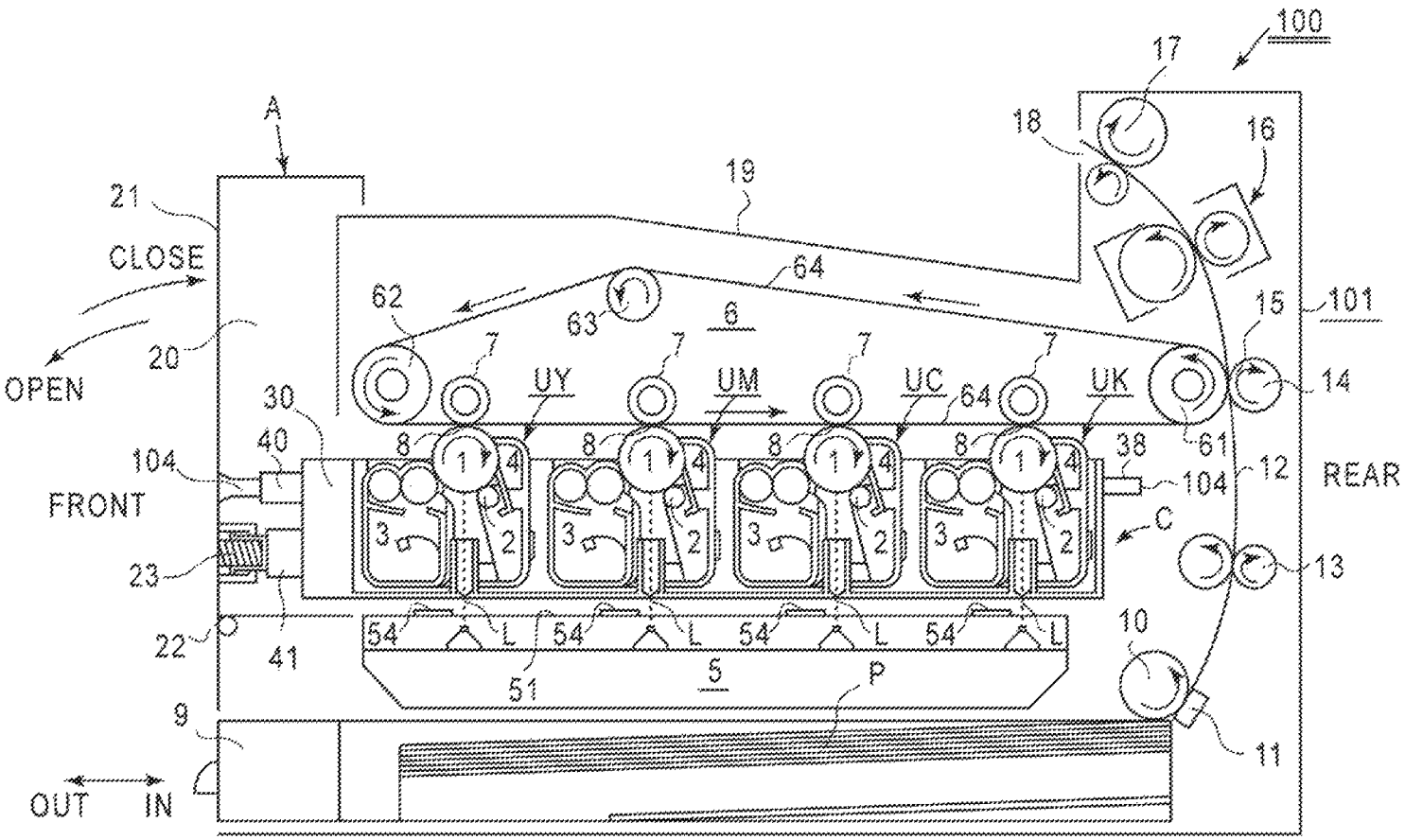
FIG. 1 is a longitudinal left side schematic view of an image forming apparatus according to Embodiment 1.

FIG. 1 is a longitudinal left side schematic view of an image forming apparatus 100 according to this embodiment. The image forming apparatus 100 a four full-color laser beam printer using an electrophotographic process and is capable of forming a image on a recording material in accordance with electrical image signal supplied to a control circuit portion from a host apparatus such as a personal computer, an image reader or the like. The host apparatus or the control circuit portion is not shown in the Figure. The recording material is a sheet on which a toner image can be formed, and it may be plain paper, glossy paper, resin material sheet, thick sheet, envelope, postcard, format paper or the like. In the following, it is simply called "sheet".

With respect to the image forming apparatus 100 of this embodiment, a front side is the side provided with a front door (apparatus openable member, outer casing) which will be described hereinafter, and a rear side is the opposite side. A frontward direction is a direction from the rear side toward the front side of the image forming apparatus 100, and a backward direction is the opposite direction. Left and right are based on the viewing direction from the front side of the image forming apparatus 100. A leftward direction is a direction from the right side toward the left side, and a rightward direction the opposite direction. Upper and lower is based on the direction of gravity.

Figure 2:
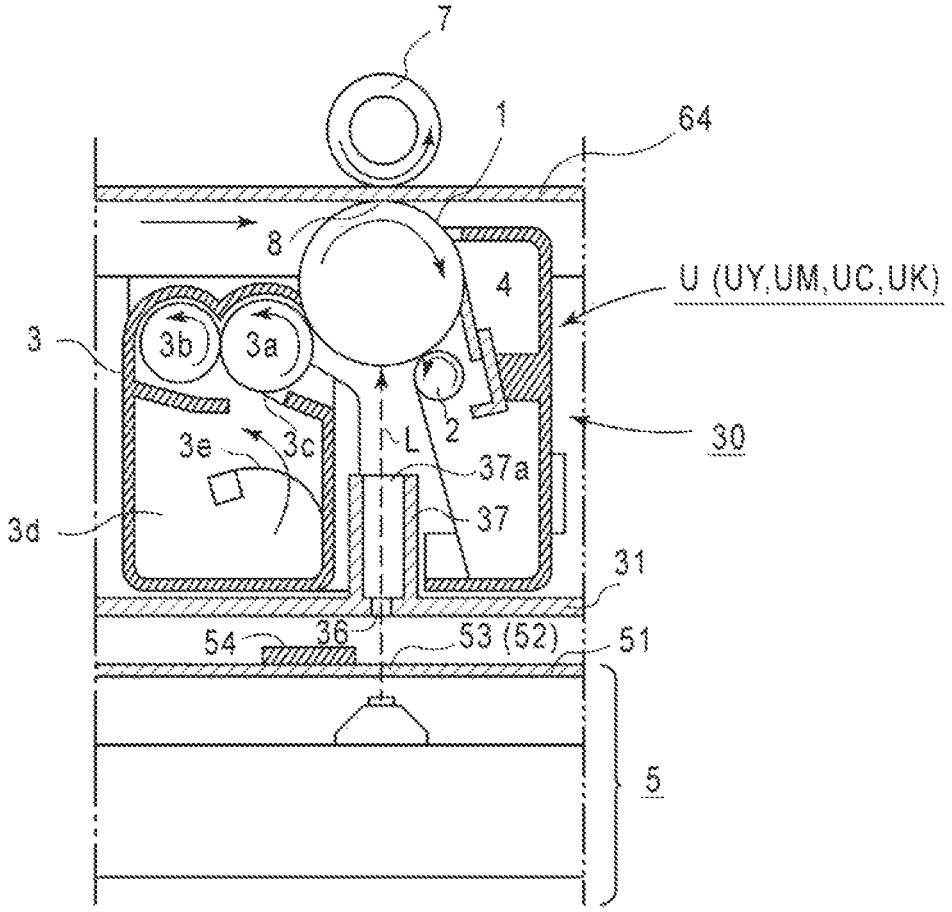
FIG. 2 is an enlarged view of one of image forming portions of the image forming apparatus shown in FIG. 1.

Inside a main assembly 101 of the image forming apparatus 100, there are provided first to fourth image forming portions U (UY, UM, UC, UK) arranged horizontally from the front side toward the rear side (in-line structure, tandem type). The image forming portions U have the similar electrophotographic processing mechanisms, although the colors of toner (developer) contained in developing devices 3 are different from each other. FIG. 2 ibis a partial enlarged view of one of the image forming portions U shown in FIG. 1.

The image forming portion U of this embodiment each include a drum type electrophotographic photosensitive member (photosensitive drum, drum) 1 as an image bearing member. The drum 1 is positioned horizontally such that an axis thereof extends in the left-right direction. The image forming portion U also includes a charging roller 2, a developing device 3 and a cleaning device 4 as the electrophotographic process means actable on the drum 1. The image forming portion U in this embodiment is unified into a unified into a cartridge (so-called integral type process cartridge) including the drum 1, the charging roller 2, the developing device 3 and the cleaning device 4, the cartridge being detachably mountable to the main assembly 101. In this embodiment, the image forming portion U is called cartridge.

Figure 3:
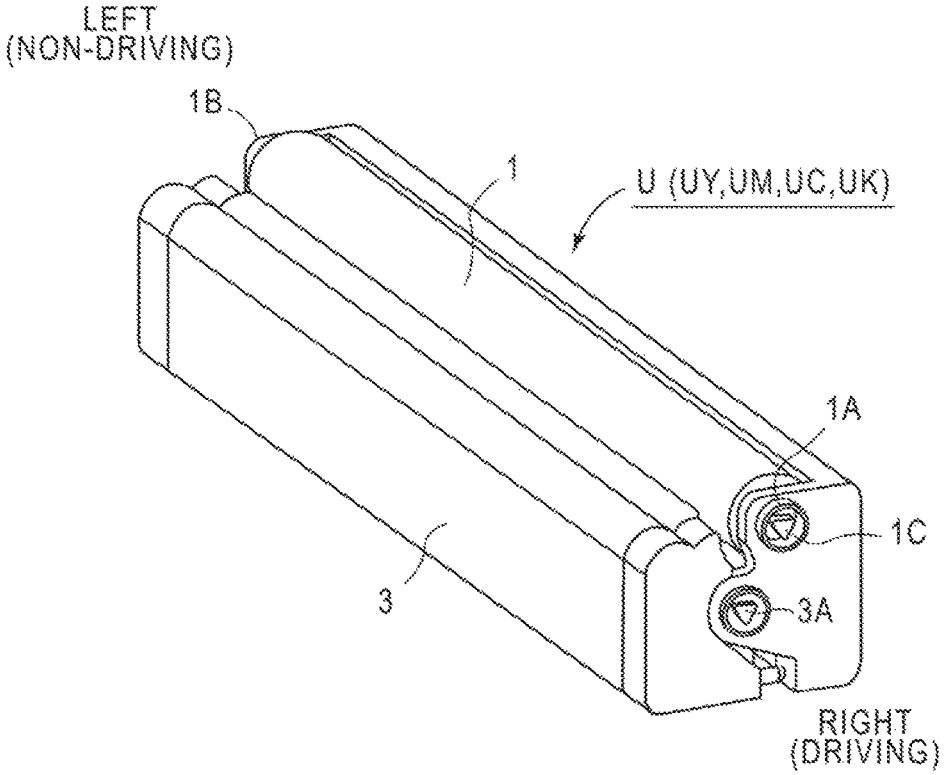
FIG. 3 is a perspective view of an outer appearance of a cartridge.

FIG. 3 is a perspective view of an outer appearance of one of the cartridges U. In this embodiment, the right-hand end side (one end portion side) of the cartridge U is a driving side, and the left-hand end side (other end portion side) thereof is a non-driving side.

The drum 1 is rotatably supported between a driving side shaft receiving portion 1A and a non-driving side shaft receiving portion 1B. At the driving side shaft receiving portion 1A, there is provided a first drive receiving coupling member 1C for receiving a driving force for rotating the drum 1 from a first drive coupling member 102 (FIG. 11) of the main assembly 101.

At the driving side of the cartridge U, there is provided a second drive receiving coupling member 3A for receiving a driving force for driving the developing device 3 from a second drive coupling member 103 (FIG. 11) of the main assembly 101.

In the first cartridge UY, the developing device 3 contains yellow color (Y color) toner to form a yellow chromatic toner image on the surface of the drum 1. In the first cartridge UM, the developing device 3 contains magenta color (M color) toner to form a magenta chromatic toner image on the surface of the drum 1. In the first cartridge UC, the developing device 3 contains cyan color (C color) toner to form a cyan chromatic toner image on the surface of the drum 1. In the first cartridge UK, the developing device 3 contains black color (K color) toner to form a black chromatic toner image on the surface of the drum 1.

Below the cartridges UY, UM, UC and UK, there is provided a laser scanner (scanner) 5 as an optical unit (exposure device) for projecting light to a lower surface of the drum 1 of each cartridge U. An upper surface plate 51 of the scanner 5 is provided with a slit-like exposure window 52 (FIGS. 2, 13) extending in the left-right direction, as a light projection opening for the cartridge U. Each of the exposure windows 52 provided with a cover glass (dust-resistant member) 53 as a transparent member (light transmission member). An upper side of the upper surface plate 51 of the scanner 5 is provided with shutter members 54 for opening and closing the exposure windows, respectively.

The scanner 5 emits a laser beam modulated in accordance with image information for the color supplied to the control circuit portion from the host apparatus through the cover glass 53 of the corresponding exposure window 52, in the direction upwardly from the bottom. The laser beam enters in the upward direction through an elongated slit-like opening 36 (FIGS. 2 and 8) formed in a bottom plate 31 of a drawer member (movable member) 30 (which will be described hereinafter) supporting the cartridge U, the opening 36 extending in the left-right direction.

An inside of the bottom plate 31 of the drawer member 30 is provided with a projection 37 (FIGS. 6 and 7) for cartridge mounting, elongated in the left-right direction at the position corresponding to the opening 36. The projection 37 has a hollow inside, the top portion of which is opened as a slit-like opening 37*a*. Therefore, the laser beam reaching the opening 36 is emergent upwardly from the opening 37*a* through the hollow portion of the projection 37. By this, the lower surface of the drum 1 of the cartridge U is exposed to and scanned by the corresponding laser beam (lower surface exposure).

About the cartridges UY, UM, UC and UK, an intermediary transfer member unit 6 is provided. The unit 6 includes a driving roller 61, a turning roller 62, a tension roller 63 and an endless intermediary transfer belt 64 extended around the rollers 61-63.

In this embodiment, the driving roller 61 and the turning roller 62 are disposed in the front side and the rear side, respectively, so that the axes thereof extend in the left-right direction in parallel with each other. The tension roller 63 is disposed inside the belt 64 between the driving roller 61 and the turning roller 62 and raises the upper traveling portion of the belt 64 to apply a tension to the belt 64.

Inside the belt 64, primary transfer rollers 7 are provided on the positions corresponding to the respective drums, such that the axes thereof extend in the left-right direction in parallel with each other. The primary transfer roller 7 is urged toward the upper surface of the drum 1 of the corresponding cartridge U through the lower traveling portion of the belt 64. By doing so, primary transfer portions (nips) 8 as the contact portions between the drums 1 and the belt 64 are formed for the respective cartridges U.

Below the scanner 5, a sheet feeding cassette 9 as a sheet accommodating portion is provided. In this embodiment, the cassette 9 can be drawn out at the front side of the main assembly 101 (front loading). When the sheets P are to be supplied into the cassette 9, the cassette 9 is drawn out of the front side of the main assembly 101. By pushing the cassette 9 into the main assembly 101, the cassette 9 is set in place so that the sheets can be supplied out of the cassette 9.

In the lower portion at the rear side in the main assembly 101, there are provided a sheet feeding roller 10 and a separation pad 11 to single out the sheet from the cassette 9. At the area side in the main assembly 101, a feeding path 12 for upwardly feeding the sheet P singled out by the sheet feeding roller 10. Along the feeding path 12, there are provided a pair of registration rollers (pair of feeding rollers) 13, a secondary transfer roller 14, a fixing device 16, a pair of sheet discharging rollers 17 and a sheet discharge opening 18 in the order named from the bottom to the top. An upper surface plate of the main assembly 101 is used as a sheet discharge tray 19.

The secondary transfer roller 14 extends in parallel with the driving roller 61 of the unit 6 and is urged toward the driving roller 61 through the belt 64. By doing so, a secondary transfer portion (nip) 15 as the contact portion between the belt 64 and the secondary transfer roller 14 is formed.

[Image Forming Operation]

The operation for forming a full-color image will be described. Referring to FIGS. 1 and 2, the drum 1 of the cartridge U is rotated in the clockwise direction indicated by an arrow at a predetermined control speed (process speed). The belt 64 is rotated in the, the clockwise direction counterclockwise direction indicated by an arrow (the same peripheral moving direction as the drum) at the speed corresponding to the rotational speed of the drum 1. The scanner 5 is also driven. The shutter members 54 of the scanner 5 are in the open positions F (FIG. 13) for opening the exposure windows 52. In synchronism with the driving of the scanner 5, the charging roller 2 uniformly charges the surface of the drum 1 to the predetermined polarity and potential at the timing predetermined for the respective cartridges U.

The scanner 5 scans the lower surface of the drum 1 with the laser beam modulated in accordance with the image signal for the corresponding color. By this, an electrostatic latent image is formed on the surface of the drum 1 corresponding to the image signal. The electrostatic latent image formed on the drum 1 is developed into a toner image by the developing device 3.

The developing device 3 (FIG. 2) comprises a developing roller 3*a* as a developer carrying member for supplying the toner onto the drum 1, the toner supplying roller 3*b* for supplying the toner onto the developing roller 3*a* and a blade 3*c* for regulating a layer thickness of the toner applied on the developing roller 3*a*. The developing device also comprises a toner accommodation chamber 3*d*, a rotation paddle 3*e* for supplying the toner (unshown) in the toner accommodation chamber 3*d* onto the toner supplying roller 3*b*.

By the above-described electrophotographic image forming process operation, a Y chromatic toner image corresponding to a Y color component of the full-color image is formed on the drum 1 of the first cartridge UY, and the toner image is primary-transferred onto the belt 64 in the primary transfer portion 8. An M chromatic toner image corresponding to a Y M color component of the full-color image is formed on the drum 1 of the second cartridge UM, and the toner image is primary-transferred onto the belt 64 in the primary transfer portion 8 superposingly on the Y chromatic toner image already transferred on the belt 64.

A C chromatic toner image corresponding to a C color component of the full-color image is formed on the drum 1 of the third cartridge UC, and the toner image is primary-transferred onto the belt 64 in the primary transfer portion 8 superposingly on the Y+M chromatic toner images already transferred on the belt 64. A K chromatic toner image corresponding to a K color component of the full-color image is formed on the drum 1 of the fourth cartridge UC, and the toner image is primary-transferred onto the belt 64 in the primary transfer portion 8 superposingly on the Y+M+C chromatic toner images already transferred on the belt 64.

In this manner, a four color unfixed toner image of Y+M+C+K colors is formed on the belt 64. Untransferred toner remaining on the surface of the drum 1 after the primary-image transfer of the toner image onto the belt 64 in the cartridge U is removed by the cleaning device 4 for the cartridge. In this embodiment, the cleaning device 4 is a blade cleaning type device.

On the other hand, the sheet feeding roller 10 is driven at predetermined control timing. By the cooperation of the sheet feeding roller 10 and the separation pad 11, one sheet is separated out (friction segment separating type) from the stack of the sheets in the cassette 9 and is supplied into the feeding path 12. Then, the sheet P fed into the secondary transfer portion 15 by the registration roller pair 13 at the predetermined control timing. In the process of the sheet the being nipped and fed through the secondary transfer portion 15, the four color superimposed toner images on the belt 64 are all transferred sequentially onto the surface of the sheet.

The sheet P is separated from the surface of the belt 64 and is introduced to the fixing device 16, where it is heated and pressed in the fixing nip. By this, the color toners are mixed and fixed on the sheet P. The sheet P discharged from the fixing device 16 is outputted onto the sheet discharge tray 19 as a full-color print through the pair of sheet discharging rollers 17 and the sheet discharge opening 18.

In the case of the monochromatic image forming mode operation, only the cartridge U that is required for the image formation on the color is operated, and the other cartridges do not operate for the image formation, although the drums rotate idly.

[Cartridge Exchanging System]

In each of the cartridges U, the toner accommodated in the developing device 3 is consumed with the image forming operations. The commercial value of the cartridge U is lost when the toner is consumed to the extent that no image that satisfies the user in the image quality can be formed.

There is provided means (unshown) for detecting the developer remainder of each cartridge U. The control circuit portion compares the detected remaining amount with a threshold for the predetermined cartridge lifetime forenotice and/or the lifetime warning. As for the cartridge U in which the detected remaining amount is smaller than the threshold, the lifetime forenotice or the lifetime warning of the cartridge U is displayed on the display portion (unshown). By this, the user is prompted to prepare for the exchange of the cartridge U or is prompted to exchange the cartridge U to maintain the quality of the outputted image.

With the image forming operation 100 of this embodiment, a front access exchange system is employed in which the cartridges U are carried on the drawer member (tray) 30 as the movable member, by which the usability is enhanced.

The front side of the main assembly 101 of the image forming apparatus 100 is provided with an opening 20 through which the cartridge U is inserted into the main assembly and is removed out of the main assembly. A front door 21 as an apparatus openable member is provided which is movable between a closing position for closing the opening 20 and the open position B (FIG. 4) for opening the opening 20.

In this embodiment, the front door 21 can be opened by the user by rotating it about the axis (hinge shaft) 22 extending in the left-right direction at the lower side of the door. More particularly, the front door 21 is lifted by rotation about the hinge shaft 22 to the close the opening of the main assembly 101, as shown in FIG. 1. When the front door 21 is completely closed, a locking mechanism (unshown) looks the door 21. By the locking, the front door 21 is stably maintained in the closing position A closing the opening 20.

Figure 4:
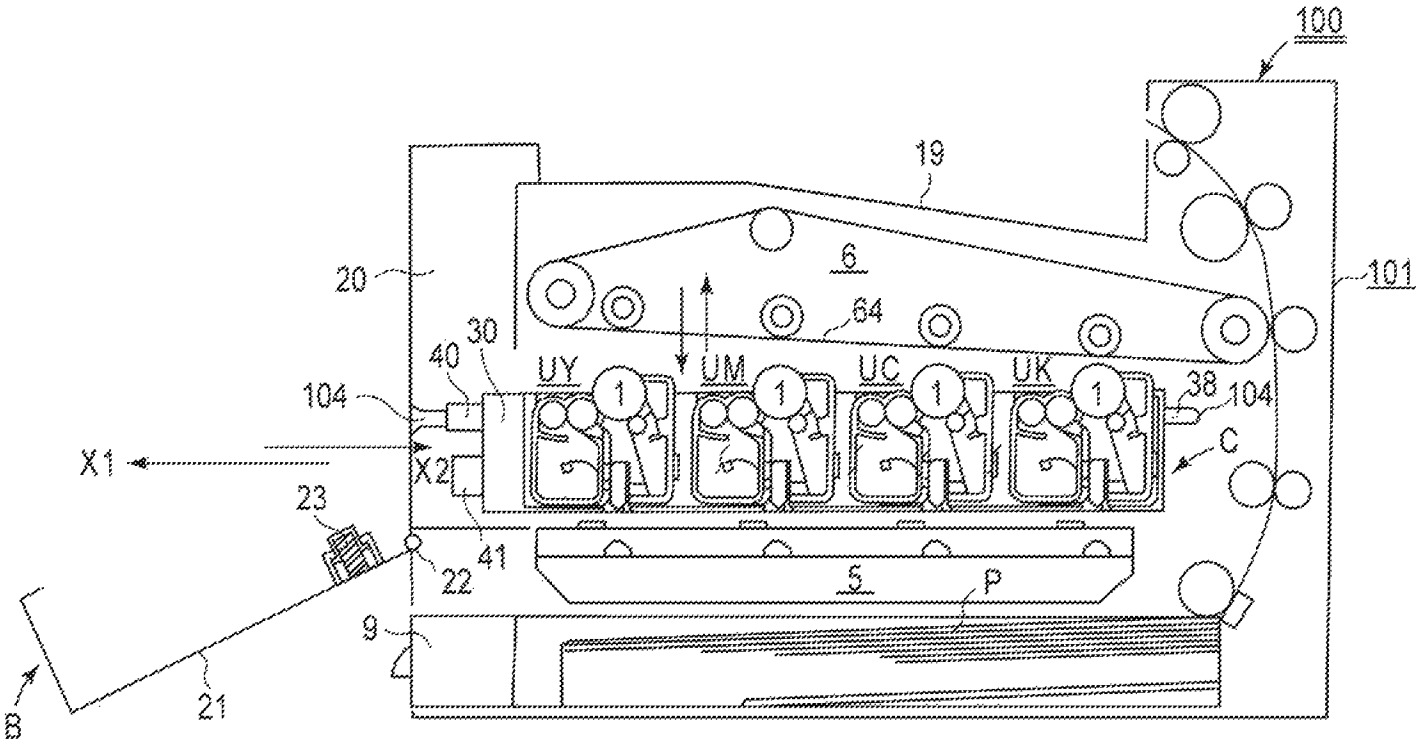
FIG. 4 is a longitudinal left side schematic view of the image forming apparatus when the front door is opened to an open position.

By the user releasing the locking mechanism and rotating the front door 21 about the hinge shaft 22 toward the front side of the main assembly 101, the front door 21 is completely open down to the predetermined open position B shown in FIG. 4. By this, the opening 20 of the main assembly 101 is widely opened.

Figure 5:
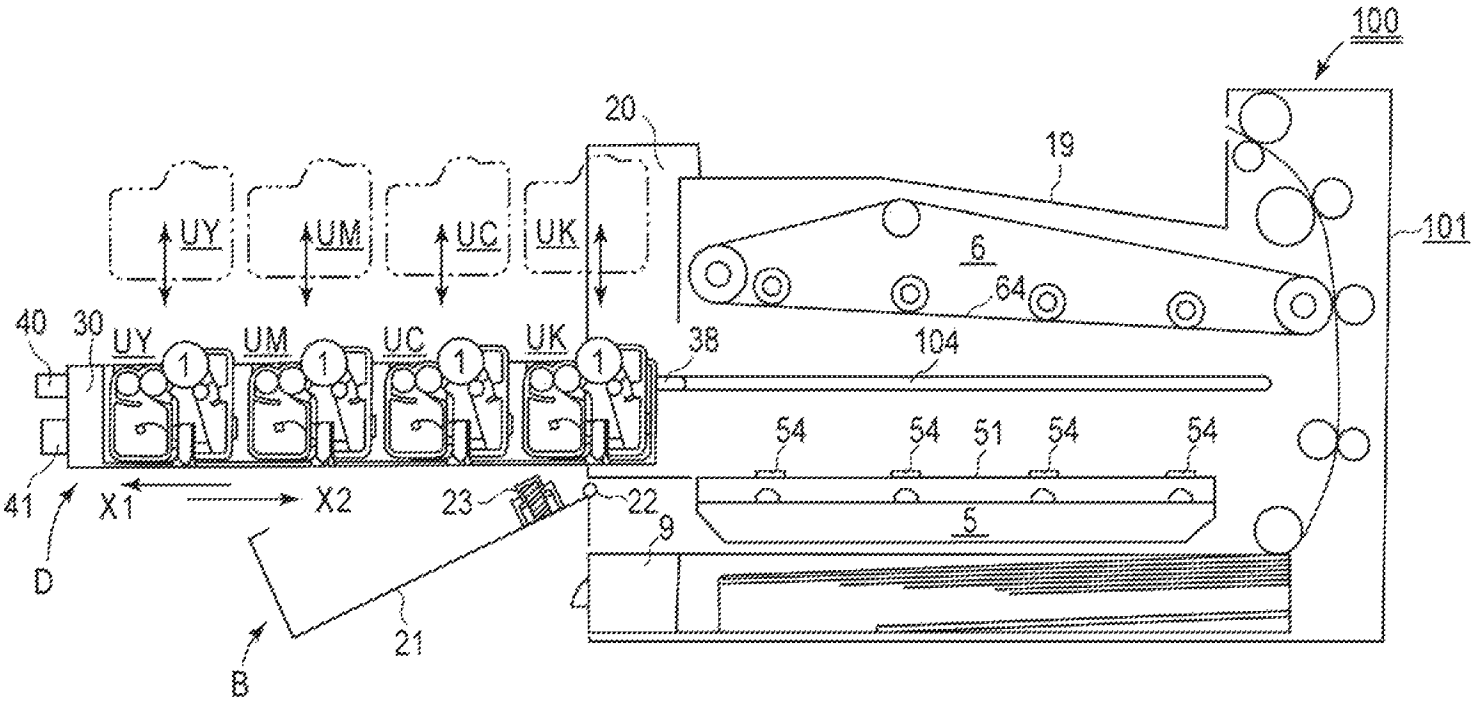
FIG. 5 is a longitudinal left side schematic view of the image forming apparatus when a drawer member is drawn out of the main assembly to an outside position.

The main assembly 101 is provided with the drawer member 30 supporting the cartridges U. The drawer member 30 is movable through the opening 20 between an inside position C (FIGS. 1 and 4) in which the image forming operation can be performed and an outside position D in which the cartridges U are exposed outside the main assembly 101 (FIG. 5).

When the drawer member 30 is in the outside position D, the cartridges U can be dismounted from the drawer member 30 and the can be mounted thereon. That is, when the drawer member 30 is in the outside position D, the user can take the cartridge U out of the drawer member 30 and can mount a fresh cartridge U on the drawer member 30.

In this embodiment, the drawer member 30 is supported so as to be slidable relative to the main assembly 101 substantially horizontally in the front and rear directions X1, X2 by the cooperation between the guiding member 104 (FIG. 10 and FIG. 11) of the main assembly side of the apparatus and the portions-to-be-guided member 38, 39 (FIG. 6 and FIG. 7) of the drawer member side. This will be described in more detail.

Figure 6:
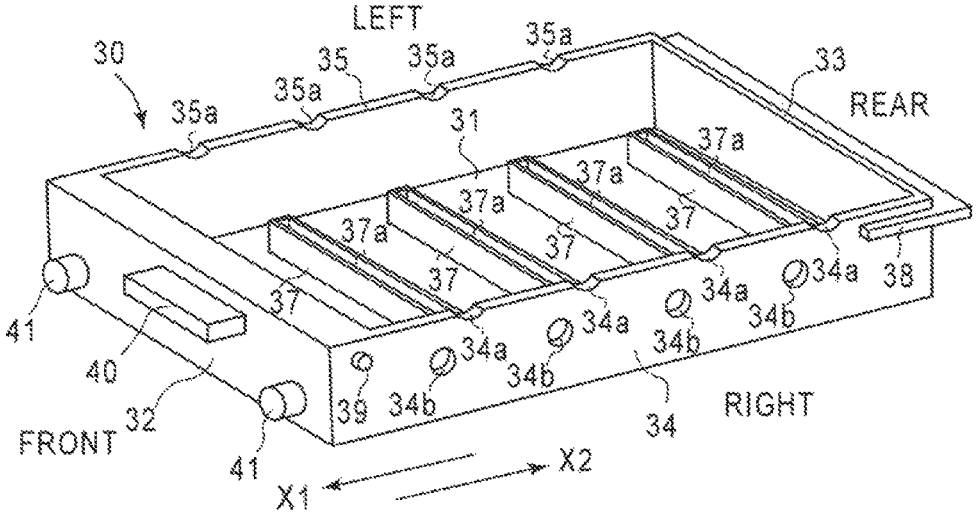
FIG. 6 is a perspective view of an outer appearance of the drawer member as seen from the right side.
Figure 7:
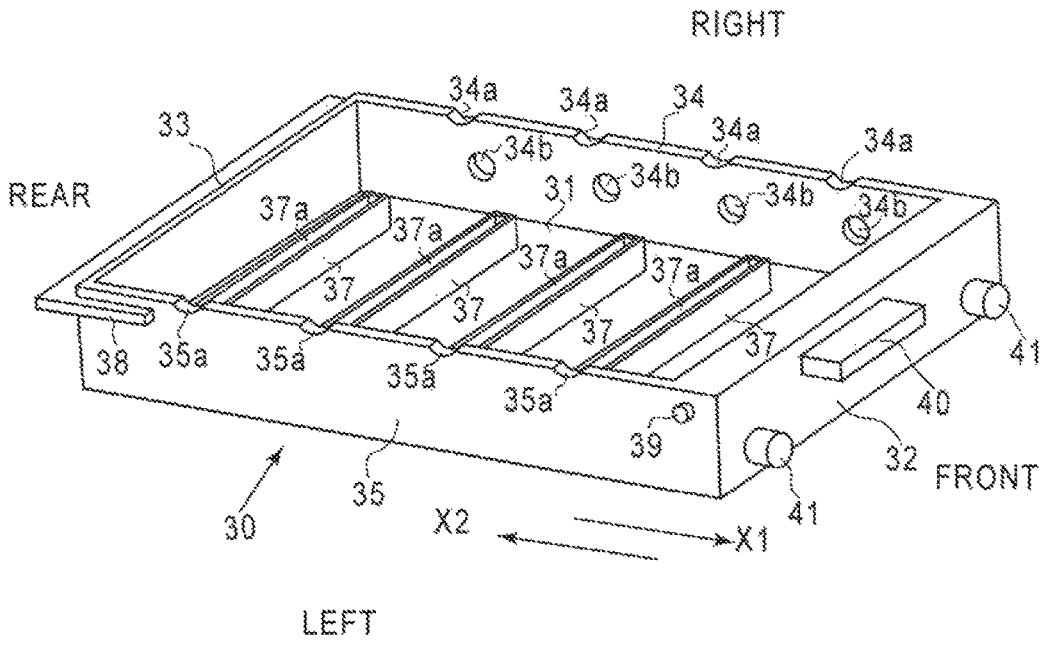
FIG. 7 is a perspective view of the outer appearance of the drawer member as seen from the left side.

As shown in FIG. 6 and FIG. 7, the drawer member 30 is generally rectangular box type member and comprises a bottom plate 31, a front frame portion 32, a rear frame portion 33, a right-hand frame portion 34 and a left-hand frame portion 35, and it is open at the top. A front side of the front frame portion 32 is provided with a grip portion 40 at a central portion with respect to the left-right direction. The front side of the front frame portion 32 is provided with a pressure receiving projection 41 at each of the left and right portions.

The outer surface of each of the right-hand frame portion 34 and the left-hand frame portion 35 is provided with a pin shaft 39 as a first portion-to-be-guided member at a front part with respect to the front and rear direction and with a rib 38 as a second portion-to-be-guided member at a rear part. The rib 38 extends in the front and rear direction, and the left and right ribs 38 extend out of the rear frame portion 33 and are connected with each other.

The box type drawer member 30 is capable of accommodating and carrying the plurality of cartridges, that is, four cartridges UY, UM, UC and UK arranged in the moving direction X1, X2 of the drawer member.

Figure 9:
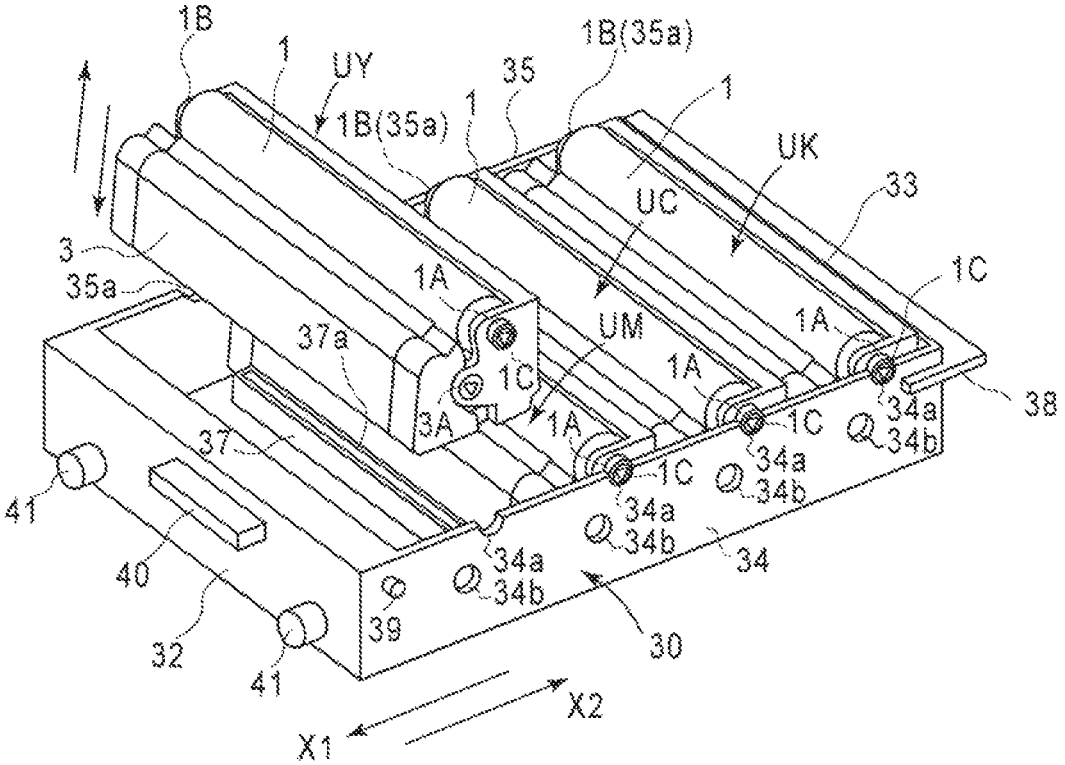
FIG. 9 is a perspective view of the outer appearance of the drawer member which supports the cartridge.

As shown in FIG. 9, the cartridge U is mounted into the drawer member 30 from the top of the drawer member 30, with the drum 1 side in the top side, the driving side (right-hand end portion side) in the right-hand frame portion 34 side and the non-driving side (left-hand end portion side) in the left-hand frame portion 35 side. At this time, a space portion elongated in the left-right direction between the developing device 3 and the cleaning device 4 of the cartridge U is fitted around the cartridge mounting projection 37 provided on the bottom plate 31 of the drawer member 30.

In this embodiment, the cartridges UY, UM, UC and UK are arranged on the drawer member 30 in the order named from the front side toward the rear side. In the state that the cartridges U are accommodated in the drawer member 30, driving side and non-driving side bearing portions 1A and 1B of the cartridge U a fitted, from the top, into recesses 34*a* and 35*a* formed at the top portions of the right-hand frame portion 34 and the left-hand frame portion 35 of the drawer member 30. The second drive receives coupling member 3A of the cartridge U is faced to the transparent hole portion 34*b* formed in the right-hand frame portion 34 of the drawer member 30.

The cartridge U accommodated in the drawer member 30 is limited by the cartridge mounting projection 33, the right-hand frame portion 34, the left-hand frame portion 35 and the recess 34*a* and of the drawer member 30. The cartridge U accommodated in the drawer member 30 can be taken out of the drawer member 30 at the top side, the shown in FIG. 9.

Figure 10:
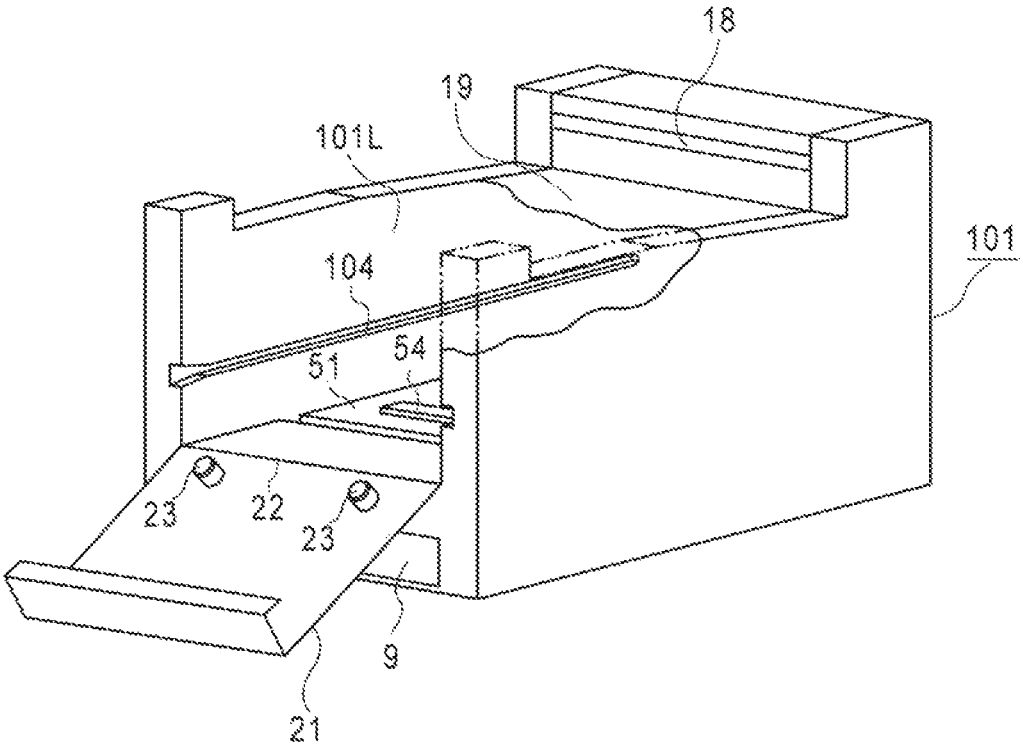
FIG. 10 is a partly cut-away perspective view of the main assembly at an inside of a left-hand frame.
Figure 11:
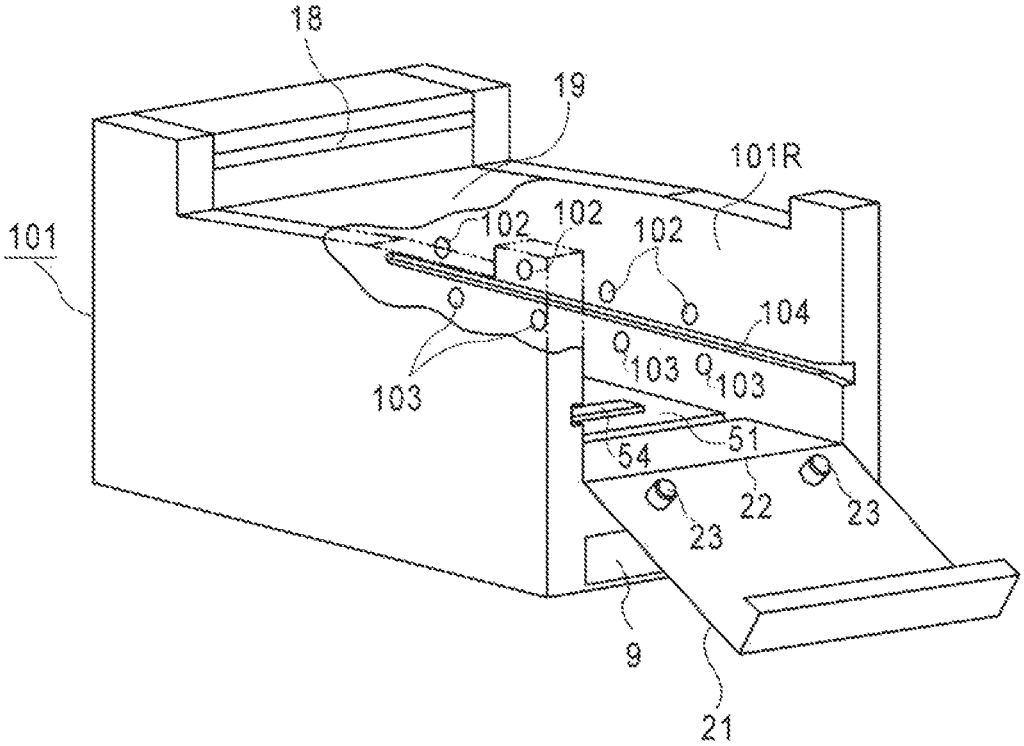
FIG. 11 is a partly cut-away perspective view of the main assembly at an inside of a right-hand frame.

As shown in FIG. 10 and FIG. 11, the main assembly 101 is provided a horizontal guide groove portion 104 as a guiding member elongated in the front and rear direction at each of mirror symmetrical positions on the inside of a right-hand frame 101R of the main assembly 101 and on the inside of a left-hand frame 101L.

The drawer member 30 is mounted between the right side and left side frames 101R and 101L of the main assembly 101 with the ribs 38 and pin shafts 39 of the right-hand frame portion 34 and the left-hand frame portion 35 being engaged with the guide groove portions 104 of the right side and left side frame 101R and 101L. By this, the drawer member 30 is supported so as to be slidable in the front and rear directions X1, X2 between the right side and left side frames 101R and 101L.

As shown in FIG. 1, the image forming apparatus 100 is capable of carrying out the image forming operation in the state that the drawer member 30 supporting the cartridges U is in the operative inside position C, and the front door 21 is locked in the closing position A.

In this state, the pressure receiving projections 41 of the drawer member 30 are contacted by the elastic urging unit 23 provided on the inside of the front door 21, by which the movement of the drawer member 30 in the backward direction X2 is prevented. By this, the rear end of the rib 38 is urged toward the end portions of the guide groove portion 104, by which the drawer member 30 is stably position at the inside position C for permitting image forming operation.

In addition, first and second drive coupling members 102 and 103 (FIG. 11) are engaged with first and second drive receiving coupling member 1C and 3A of the cartridge U supported on the drawer member 30, respectively. The second drive coupling member 103 enters the through-hole portion 34*b* (FIG. 6) of the right-hand frame portion 34 of the drawer member 30 from the outside into the inside to engage with the second drive receiving coupling member 3A of the cartridge U. An electrical receiving portion (unshown) of the cartridge U is connected with an electrical supplying portion of the main assembly 101.

The shutter member 54 of the scanner 5 is in the open position F (FIG. 13) for opening the exposure window 52. The belt 64 of the intermediary transfer member unit 6 contacts to the drum 1 of each of the cartridges U.

By the user releasing the locking of the front door 21 and moving the front door 21 from the closing position A to the open position B (FIG. 4), the opening 20 of the main assembly 101 is widely opened. By the opening of the front door 21, the drawer member 30 side pressure receiving projection 41 is released from the elastic urging unit 23 of the front door 21. That is, the positioning and the fixing for the drawer member 30 by the elastic urging unit 23 are released.

By the operation of the interrelating mechanism (unshown) in interrelation with the movement of the front door 21 from the closing position A to the open position B, the drive coupling members 102 and 103 of the main assembly 101 a retracted from the drive receiving coupling members 1C and 3A of the cartridge U. The connection between the electric the receiving portion of the cartridge U and the electric the supplying portion of the main assembly is also broken.

By the opening operation of the interrelating mechanism, the intermediary transfer member unit 6 is moved from the operative position shown in FIG. 1 to the upper retracted position shown in FIG. 4 by pivoting about the driving roller 61 side. That is, the belt 64 is separated from the drums of the cartridges U.

In this state, the drawer member 30 is pulled out of the main assembly 101 through the opening 20 as shown in FIG. 5 to the outside position D when the cartridges U are exposed.

That is, in the state shown in FIG. 4, the grip portion 40 of the front frame portion 32 of the drawer member 30 is exposed outwardly through the opening 20. The user grips the grip portion 40 and pull the drawer member 30 out, by which the drawer member 30 is drawn out while the pin shafts 39 and the ribs 38 which the portions-to-be-guided member sliding in the guide groove portions 104 which of the main assembly 101 side guiding member. The intermediary transfer member unit 6 is in the retracted position in the main assembly, and because the belt 64 is out of contact with the upper surfaces of the drums 1 of the cartridges U, the drums 1 do not rub the belt 64 during the outward drawing of the drawer member 30.

In the initial stage of the movement of the drawer member 30, the shutter members 54 of the scanner 5 are moved with the movement of the drawer member 30 from the open position F (FIG. 13) opening the corresponding exposure windows to the closing position E (FIG. 12) closing the exposure window.

The drawer member 30 is drawn out to the predetermined outside position D through the opening 20 as shown in FIG. 5. By doing so, all of the four cartridges U supported on the drawer member 30 is moved through the opening 20 to the outside position where they are all exposed, thus permitting the user to access the cartridges U.

In the process of drawing the drawer member 30 out, the pin shaft 39 is disengaged from the guide groove portion 104, but the rib 38 elongated in the front and rear direction is still in engagement with the guide groove portion 104, and therefore, the drawer member 30 can be stably drawn out while maintaining the horizontal state. When the drawer member 30 is drawn out to the predetermined outside position D, the further drawing-out movement of the drawer member 30 is prevented by a stopper member (unshown). In such a state, the rib 38 elongated in the front and rear direction is still in engagement with the guide groove portion 104, and therefore, the drawer member 30 is stably maintained in the horizontal state.

The cartridges U can be taken out upwardly from the drawer member 30, individually. The cartridges U can be mounted on the drawer member 30 downwardly, individually. Therefore, the user removes upwardly the use-up cartridge U to be replaced, as indicated by the chain line in FIG. 5. Then, a fresh cartridge U is inserted from the top into the drawer member 30.

After the replacement of the cartridge, the user pushes the drawer member 30 in the backward direction X2 into the main assembly 101. Thus, the drawer member 30 is pushed into the main assembly 101 to the predetermined inside position C shown in FIG. 4. The intermediary transfer member unit 6 in the retracted position, and therefore, the belt 64 is kept out of contact with the upper surfaces of the drums 1 of the cartridges U, and no rubbing occurs between the belt 64 and the drum 1 in the process of the movement of the drawer member 30 to the predetermined inside position C.

In the process of the inward movement of the drawer member 30, the pin shaft 39 ibis engaged with the guide groove portion 104. Immediately before the arrival of the drawer member 30 at the inside position C, the shutter members 54 of the scanner 5 start to move from the closing position E (FIG. 12) toward the open position F (FIG. 13) for opening the exposure window. When the drawer member 30 placed in the predetermined inside position C, the shutter members 54 are moved to the open position F sufficiently opening the corresponding exposure windows 52.

After returning the drawer member 30 to the inside position C, the user closes the front door 21. When the front door 21 is closed sufficiently, it is locked in the closing position A by the locking mechanism.

By the front door 21 being closed, the drawer member 30 is urged in the backward direction X2 by the elastic urging unit 23 of the front door 21 urging the pressure receiving projections 41. By this, the rear end of the rib 38 is pressed against the end portion of the guide groove portion 104, so that the drawer member 30 is stably position at the inside position C where the image forming apparatus is capable of carrying out the image forming operation.

By the operation of the interrelating mechanism (unshown) in interrelation with the movement of the front door 21 from the open position B two of the closing position A, the drive coupling members 102 and 103 of the main assembly 101 are engaged with the drive receiving coupling members 1C of the cartridge U. The electrical supplying portion of the main assembly side is connected with the electrical receiving portion of the cartridges U. In addition, by the interrelating mechanism (unshown) in interrelation with the movement of the front door 21 from the open position B toward the closing position A, the intermediary transfer member unit 6 lowers and returns from the retracted position to the operative position in which the belt 64 contacts the drums 1 of the cartridges U.

By this, the image forming apparatus 100 is reset to the operative state in which the image forming operation can be carried out.

The drawer member 30 retained in the outside position D by the stopper member as shown in FIG. 5 can be disengaged from the main assembly 101 by disengaging the stopper member. Therefore, if necessary, the user can release the stopper member from the main assembly, and disengage the drawer member 30 from the main assembly 101 and then replace the cartridge or cartridges. The drawer member 30 can be supported by the main assembly 101 by reengaging the left and right ribs 38 with the guide groove portions 104 of the main assembly 101.

The sliding movement structure for the drawer member 30 relative to the main assembly 101 is not limited to the above-described structure of this embodiment including the ribs 38 and pin shafts 39 as the portion-to-be-guided members provided on the drawer member 30 and the guiding groove 104 as the guiding member provided on the main assembly 101.

For example, the pin shafts 39 may be omitted, and the ribs 38 may be extended over substantially the entire length in the front and rear direction of each of the right-hand frame portion 34 and the left-hand frame portion 35. Further alternatively, the portion-to-be-guided member of the drawer member 30 may be a groove, and the guiding member of the main assembly 101 may be a rib. Even further alternatively, an Accuride rail may be used.

The positioning and releasing structures for the drawer member 30 relative to the inside position C are is not limited to the combination of the pressure receiving projection 41 and the elastic urging unit 23. For example, a latch mechanism may be used to retain and release the drawer member 30.

The positioning structure for the cartridge U relative to the drawer member 30 is not limited to that of this embodiment. The following is an alternative example.

The main assembly 101 is provided with a cartridge urging mechanism for pressing and releasing the cartridge in interrelation with the closing and opening operation of the front door 21. And, when the drawer member 30 carrying the cartridges U is moved to the inside position C, and the front door 21 is closed, the cartridge urging mechanism is operated to urge the cartridge to press the cartridge into the drawer member 30. When the front door 21 is opened in this state, the cartridge urging mechanism is operated to release the pressing of the cartridge U relative to the drawer member 30.

[Shutter Member and Opening and Closing Mechanism].

Figure 12:
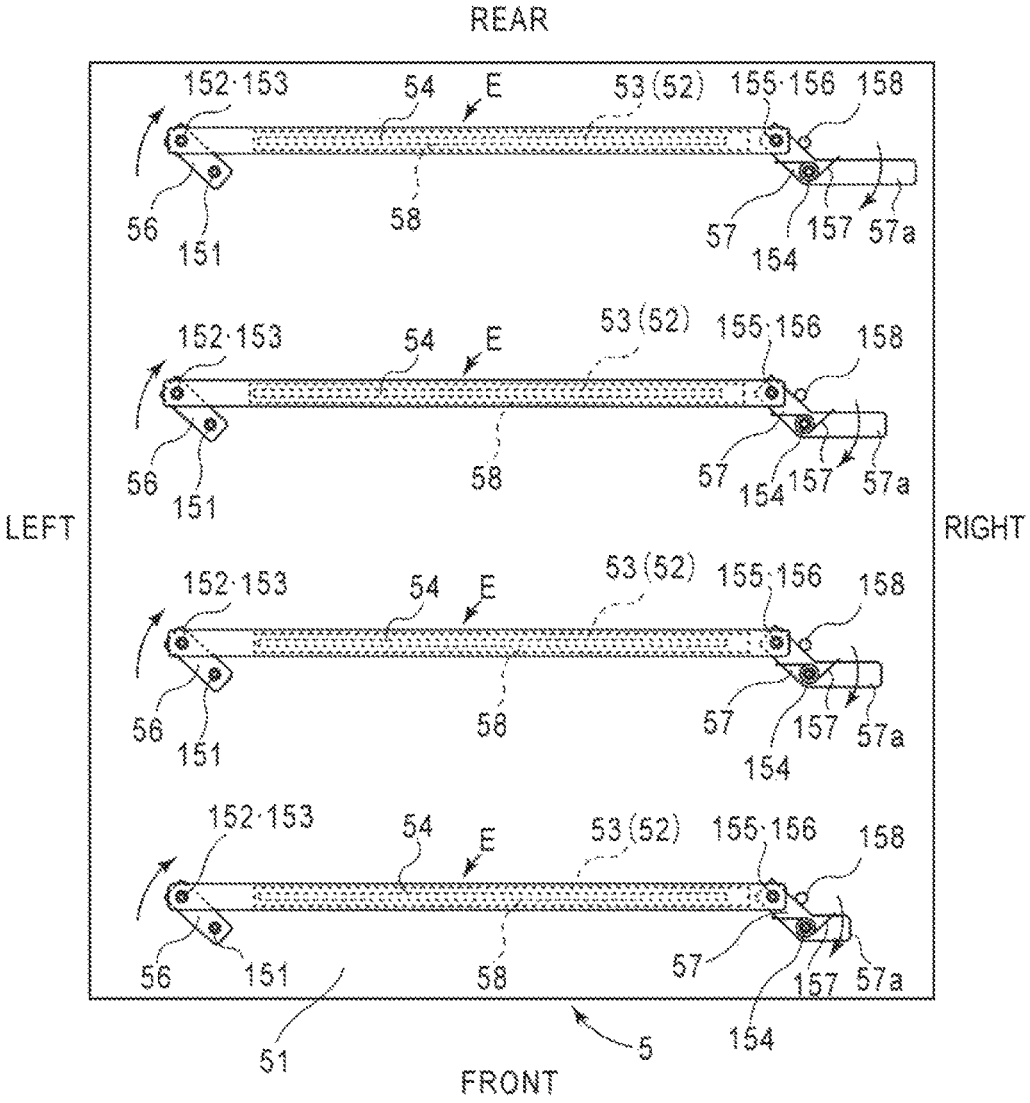
FIG. 12 is a top plan view of an optical unit when the shutter member is in the closing position.
Figure 13:
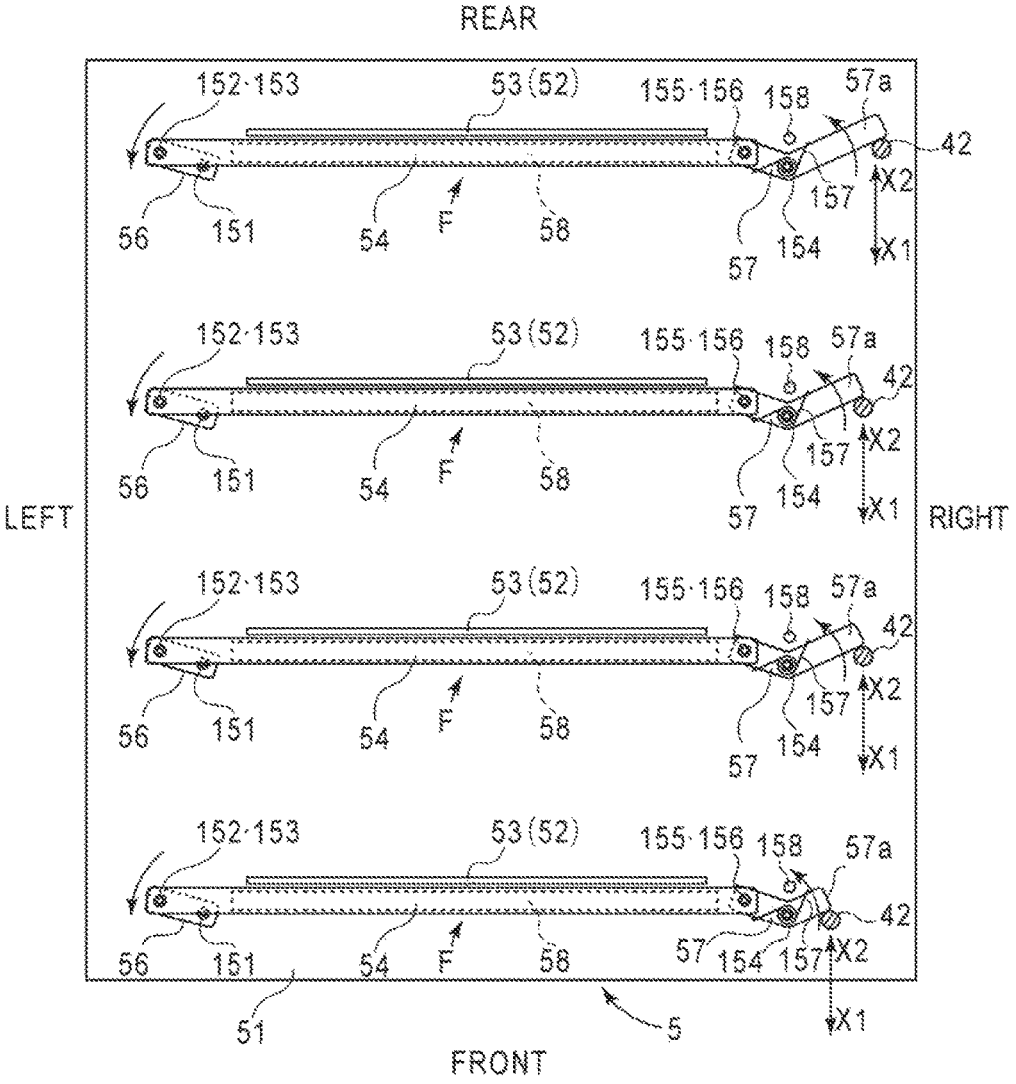
FIG. 13 is a top plan view of the optical unit when the shutter members are in the open positions.

FIG. 12 and FIG. 13 are top plan views of the scanner 5. FIG. 12 shows the state in which the shutter members 54 for opening and closing the exposure windows 52 corresponding to the cartridges U close the exposure windows 52 are in the closing positions E for closing the optical paths for the laser beams L to be projected onto the corresponding drums 1 from the scanner 5. FIG. 13 shows the state in which the shutter members 54 open the exposure windows 52, that this, it is in the open position F for opening the optical path for the laser beams L.

The upper surface plate 51 of the scanner 5 is provided with exposure windows in the form of slits elongated in the left-right direction, as the openings for permitting light projection for the respective cartridges U. Each of the exposure windows 52 provided with a cover glass (dust-resistant member) 53 as a transparent member (light transmission member). The cover glass 53 permits the laser beam L emitted from the inside of the scanner to pass toward the outside while preventing dust, toner or the like entering from the outside of the exposure window into the inside of the scanner, thus preventing occurrence of image defect attributable to the contamination of the function parts inside the scanner. An upper side of the upper surface plate 51 of the scanner 5 is provided with shutter members 54 for opening and closing the exposure windows, respectively.

The shutter member 54 is a plate member elongated in the left-right direction, and it has a length larger than the length of the exposure window 52 and has a width larger than the width of the exposure window. The shutter member 54 at the left-hand end portion is rotatably supported by the upper surface plate 51 of the scanner 5 through a swingable arm 56 having a base portion supported swingably about the vertical shaft 151 and a free end portion rotatably supporting the shutter member 54 by the engagement between a round hole 152 and a boss 153. In the right-hand end portion, the shutter member 54 ibis rotatably supported by the upper surface plate 51 through a lever 57 swingable about a vertical shaft 154 having one end rotatably supporting the shutter member 54 by engagement between a round hole 155 and a boss 156.

A distance between the vertical shaft 151 of the swingable arm 56 and the boss 153 and the distance between the vertical shaft 154 of the lever 57 and the boss 156 of the same. The distance between the vertical shafts 151 and 154 and the distance between the bosses 153 and 156 are the same. Thus, shutter member 54, the swingable arm 56, the lever 57 and the upper surface plate 51 establish a parallelogram link mechanism. By the swing the lever 57 of the parallelogram link mechanism, the shutter member 54 translates relative to the exposure window between the closing position E and the open position F. That is, the parallelogram link mechanism functions as the opening and closing mechanism for the shutter member 54.

The lever 57 of the parallelogram link mechanism is normally urged by a coil spring 157 in the clockwise direction indicated by an arrow in FIG. 12 about the vertical shaft 154. That is, the shutter member 54 is biased to the exposure window. In the free state of the lever 57, the lever 57 is rotated in the clockwise direction about the vertical shaft 154 to be stopped by a stopper pin 158. The coil spring 157 is an urging member urging the shutter member 54 in the direction from the open position F to the closing position E.

In the state of the lever 57, the shutter member 54 is retained in the closing position E covering the exposure window (FIG. 12). By the lever 57 being rotated in the counterclockwise direction about the vertical shaft 154 against the urging force of the coil spring 157, the shutter translates from the closing position E of FIG. 12 to the open position F for opening the exposure window, frontwardly as shown in FIG. 13. In the image forming apparatus 100 of this embodiment, the shutter member 54 is provided for each of four cartridges U as the plurality of image forming portions.

In this embodiment, the shutter member 54 is opened and closed in interrelation with the movement of the drawer member 30 toward and away from the inside position. By this, the contamination of the optical unit 5 (contamination of the cover glass 53 of the exposure window 52) with the dust, the toner or the like is reduced, and the opening and closing mechanism for the shutter member 54 is accomplished at a low cost. More detailed description will be made.

Figure 8:
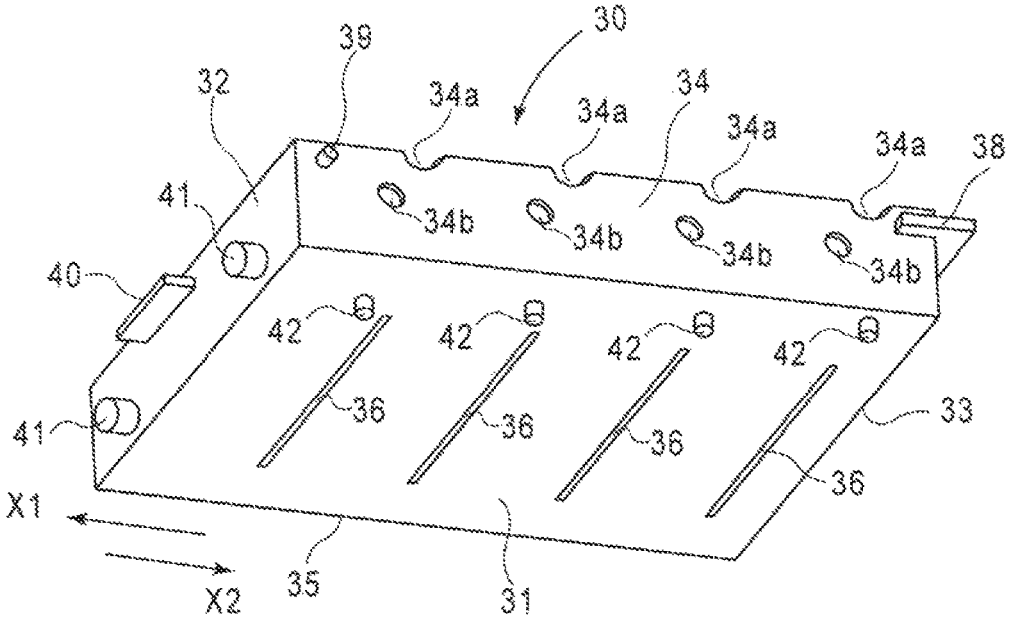
FIG. 8 is a perspective view of the outer appearance of the drawer member as seen from the bottom side.

As shown in FIG. 8, on the right side of the lower surface of the bottom plate 31 of the drawer member 30, there are provided downward projections 42 as engaging portions engageable with the other arm portion (portion-to-be-engaged) 57*a* of the lever 57 in the optical unit 5. In the state that the drawer member 30 is in the inside position C of the main assembly 101, the four projections 42 are engaged with the other arm portions 57*a* of the corresponding levers 57 as shown in FIG. 13.

In the state shown in FIG. 13, the levers 57 are rotated in the indicated counterclockwise direction by predetermined angles about the corresponding vertical shafts 154 against the urging forces of the corresponding coil springs 157 by the engagement with the corresponding projections 42. By this, the shutter members 54 are in the open position F, so that the exposure windows 52 are opened to permit the light projection from the scanner 5 onto the corresponding drums 1 of the cartridges U.

When the front door 21 is opened for replacement of the cartridge, and the drawer member 30 is drawn out toward the outside position D in the frontward direction X1 from the inside position C of the main assembly 101, the projections 42 also move in the frontward direction X1. That is, the projections 42 move outweigh from the other arm portion 57*a* of the levers 57 in the frontward direction X1 (spacing operation).

With this operation, the levers 57 are rotated by the urging forces of the corresponding coil springs 157 about the vertical shafts 154 in the indicated clockwise direction until the rotation is stopped by the stopper pin 158 as shown in FIG. 12. By this, the shutter members 54 move from the open position F shown in FIG. 13 to the closing position E shown in FIG. 12, so that the exposure window 52 is covered by the shutter member 54.

When the drawer member 30 moves from the inside position C to the outside position D, the shutter member 54 is moved from the open position F to the closing position F. When the drawer member 30 moves from the outside position D to the inside position C, the shutter member 54 is moved from the closing position F to the open position E. These operations are carried out by the above-described operating portion (shutter moving means). In this embodiment, the operating portion includes the parallelogram mechanisms on the scanner 5, and the projections 42 on the drawer member 30.

Here, in this embodiment, the positions of the projections 42 are all different with respect to the direction (perpendicular to the arrow X1, X2 directions, longitudinal direction of the drum 1) perpendicular to the moving direction of the drawer member 30. The lengths of the arm portions 57*a* are all different. More particularly, the rearer side ones (downstream side with respect to the inserting direction of the drawer member 30) are more outside of the drawer member 30. The lengths of the arm portions 57*a* of the rearer side are longer. In FIG. 12, the arm portions 57*a* in the rearer sides are extended more toward the right side.

Therefore, when the drawer member 30 is inserted, the projections 42 contact only to the corresponding arm portions 57*a*, respectively. For example, the rearest projection 42 contacts only to the rearest arm portion 57*a* and does not contacted to the other three arm portions 57*a*. That is, the rearest projection 42 simply passes by the arm portion 57*a* at the outside with respect to the longitudinal direction of the drum. Heretofore, no malfunction of the shutter member 54 caused by the contact of the projection 42 to a non-corresponding arm portion 57*a*, and no impedance against the movement of the drawer member 30 by the contact of a projection 42 to an non-corresponding arm portion 57*a* occurs.

In the process of the movement of the drawer member 30 in the backward direction X2 (from the outside position D toward the inside position C), the four engaging portions 42 contact to the corresponding arm portions 57*a* and open the corresponding shutter members 54, substantially simultaneously. That is, the shutter members 54 are opened substantially at the same timing.

On the other hand, in the process of the movement of the drawer member 30 in the frontward direction X1 (the movement from the inside position C toward the outside position D), the four engaging portions 42 are disengaged from the corresponding arm portions 57*a* substantially simultaneously. That is, the four shutter members 54 are closed substantially at the same timing.

The movement of the shutter member 54 may cause scattering of the powder dust or toner deposited on the shutter member 54. If when a shutter member 54 is closed, another shutter 54 for an exposure window 52 is open, the exposure window 52 may be contaminated with the powder dust or the like. According to the present invention, however, the close timing of the shutter members 54 is the same, and therefore, even if the powder dust or the toner is scattered at a certain shutter member, the exposure windows 52 are all closed by the shutter member 54. For this reason, the deposition of the powder dust or the like onto the exposure windows can be suppressed.

It is not inevitable that all of the shutter members 54 are closed at the same timing and opened at the same timing. It will suffice if all the shutter members 54 are moving at a certain instance (timing). In other words, it will suffice if at the predetermined timing (particular instance) during the movement of the drawer member 30 from the outside position to the inside position, all the shutter member 54 are moving from the closing position E toward the open position F.

The movement of the shutter member 54 from the open position F toward the closing position E is caused in an initial stage of the movement of the drawer member 30 from the inside position C in the frontward direction X1. The this, by the start of the movement of the drawer member 30 from the inside position C in the frontward direction X1, the projection 42 disengages, by which the lever 57 is rotated until it is stopped by the stopper pin 158 quickly.

The this, the timing of this part of the movement of the shutter member 54 from the closing position E toward the open position F arises in the initial stage of the movement of the drawer member 54 from the inside position C toward the outside position D. That is, the movement distance of the drawer member 54 until the shutter member 54 starts the movement toward the open position F is smaller than one half of the entire movement distance required for the drawer member 54 to move from the inside position C to the outside position D. In this embodiment, the movement distance is less than a quarter of the entire movement distance. Here, the movement distance is the distance measured along the moving direction of the drawer member 54.

Therefore, the exposure windows 52 are covered by the corresponding shutter members 54 during the drawing movement process of the drawer member 30 from the inside position C to the outside position D and during the exchanging operation of the cartridge U relative to the drawer member 30 placed in the outside position D. Therefore, the contamination of the surface of the cover glass 53 of the exposure window with the dust, toner or the like attributable to the vibration or the like imparted during the drawing movement of the drawer member 30 and/or the mounting and demounting exchanging operation of the cartridge U can be reduced.

In addition, in the final stage of the returning movement of the drawer member 30 from the outside position D to the inside position C in the backward direction X2, the projections 42 of the drawer member 30 contact (engage) to the other arm portions 57*a* of the corresponding levers 57. With the continuing movement of the drawer member 30 in the backward direction X2, the levers 57 are rotated in the counterclockwise direction in FIG. 13 around the vertical shaft 154 against the urging forces of the corresponding coil springs 157, so that the shutter members 54 are moved from the closing position E of FIG. 12 toward the open position F.

By the drawer member 30 reaching the inside position C, the further movement thereof in the backward direction X2 is prevented, and therefore, the rotations of the levers 57 also stop. Thus, the shutter members 54 are retained in the open positions F of FIG. 13.

The movement of each shutter member 54, the closing position E to the open position F is effected in the short period immediately before the final stage of the movement of the drawer member 30 back to the inside position C. In the movement process of the drawer member 30 from the outside position D to the inside position C, the exposure window 52 is covered by the shutter member 54 in the period immediately before the final stage of the movement of the drawer member 30 back to the inside position C. By this, the contamination of the surface of the cover glass 53 of the exposure window due to the falling and/or scattering of the dust and/or toner or the like caused by the vibration in the returning movement of the drawer member 30 can be reduced.

As described in the foregoing, the shutter member 54 is opened and closed in interrelation with the in and out movement of the drawer member 30. By this, the contamination of the optical unit 5 (contamination of the cover glass 53 of the exposure window 52) with the dust, the toner or the like is reduced, and the opening and closing mechanism for the shutter member 54 is accomplished at a low cost.

Figure 27:
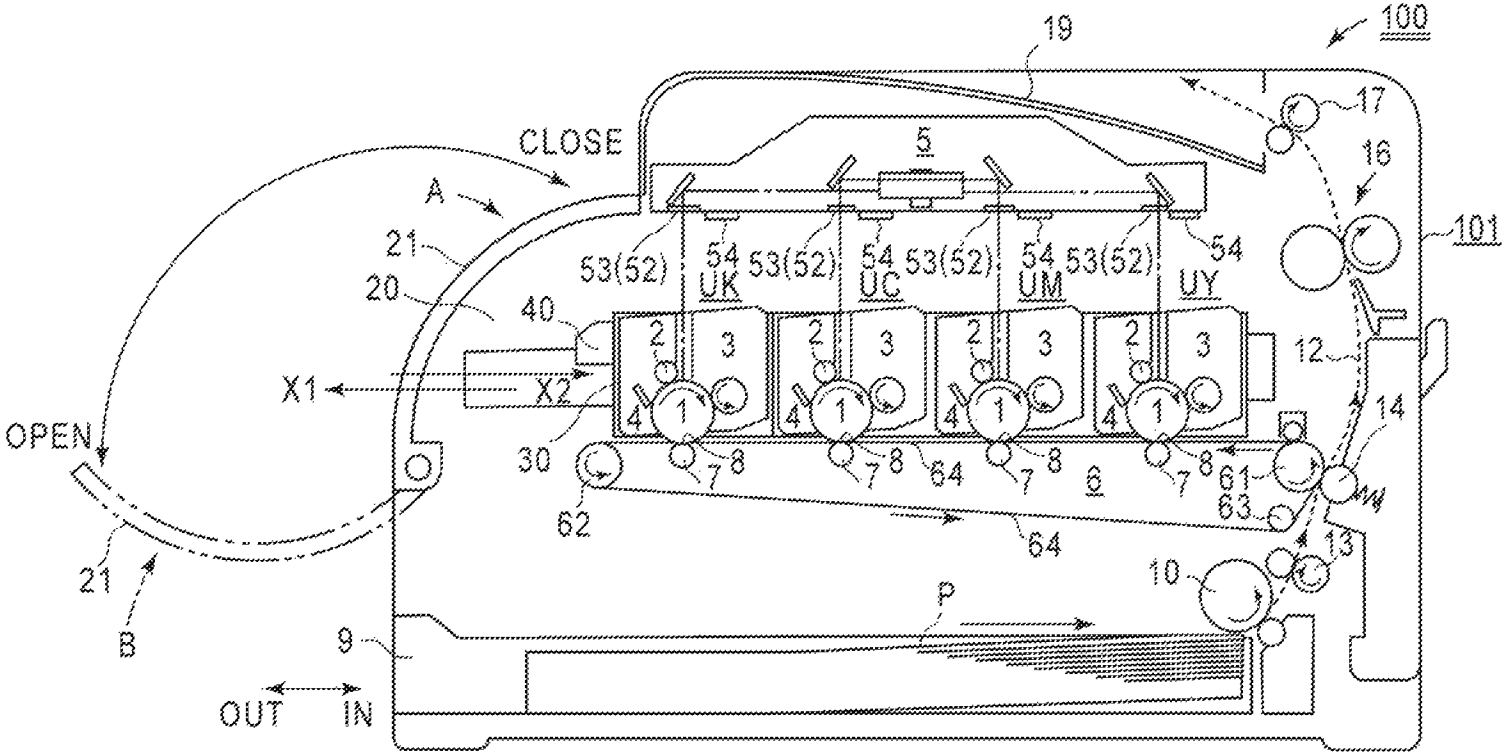
FIG. 27 is an illustration of an upper surface exposure structure.

In this embodiment, the image forming apparatus is a lower surface exposure type, in which a scanner unit 5 is below a drawer member 30 and a cartridge U. The image forming apparatus may be of an upper surface exposure type, in which the scanner unit 5 is provided above the drawer member 30 and the cartridge (FIG. 27).

However, with the structure of the image forming apparatus 100 of this embodiment, in which the drum 1 of the cartridge U supported by the drawer member 30 is exposed at the lower surface of the drum through the drawer member 30 using the scanner unit 5, the drawer member 30 and the unit 5 may be disposed close to each other.

By this, the linking distance between the drawer member 30 and the opening and closing mechanism for the shutter member 54 in the unit 5 side can be reduced. Therefore, with the image forming apparatus having the lower surface exposure structure, the linking structure between the drawer member 30 and the unit 5 for interrelating the opening and closing operation of the shutter member 54 with the movement of the drawer member 30 can be simplified, and therefore, the opening and closing mechanism for the shutter member 54 can be manufactured at low cost.

[Cleaning of Cover Glass]

Figure 14A:
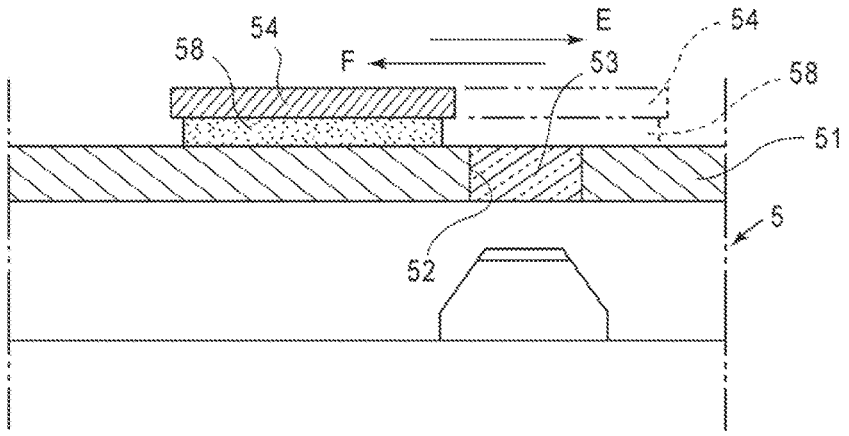
FIGS. 14(*a*) and 14(*b*) are illustrations of a cleaning member for removing contamination of a surface of a transparent member provided covering a light projection opening of the optical unit.
Figure 14B:
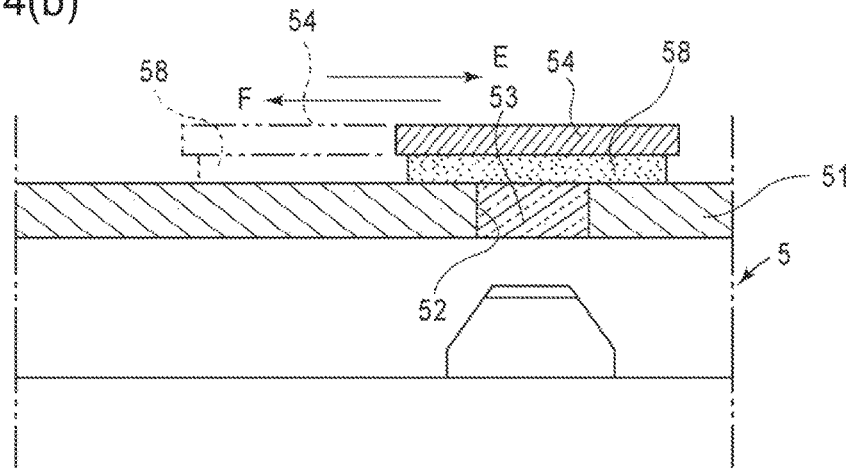

In this embodiment, a lower surface of the shutter member 54 (the surface facing the exposure window) is provided with a cleaning member 58 extending in the longitudinal direction of the shutter member 54 to clean the cover glass 53. FIGS. 14(*a*) and 14(*b*) are cross-sectional views of the shutter member 54. The cleaning member 58 is made of nonwoven fabric, felt, fur member or brush member. The cleaning member 58 is contactable to the surface (outer surface) of the cover glass 53 covering the exposure window 52.

As shown in FIGS. 14(*a*) and 14(*b*), the cleaning member 58 removes the surface contamination of the cover glass 53 by rubbing the cover glass 53 when the shutter member 54 moves between the open position F and the closing position E. By this, the production of the image defect attributable to the surface contamination of the cover glass 53 can be reduced.

Embodiment 2

This embodiment is similar to Embodiment 1, but the opening and closing mechanism for the shutter member 54 is different from that shown in FIG. 12 through FIGS. 14(*a*) and 14(*b*). In the description of this embodiment, the same reference numerals as in Embodiment 1 are assigned to the elements having the corresponding functions in this embodiment, and the detailed description thereof is omitted for simplicity.

Figure 15:
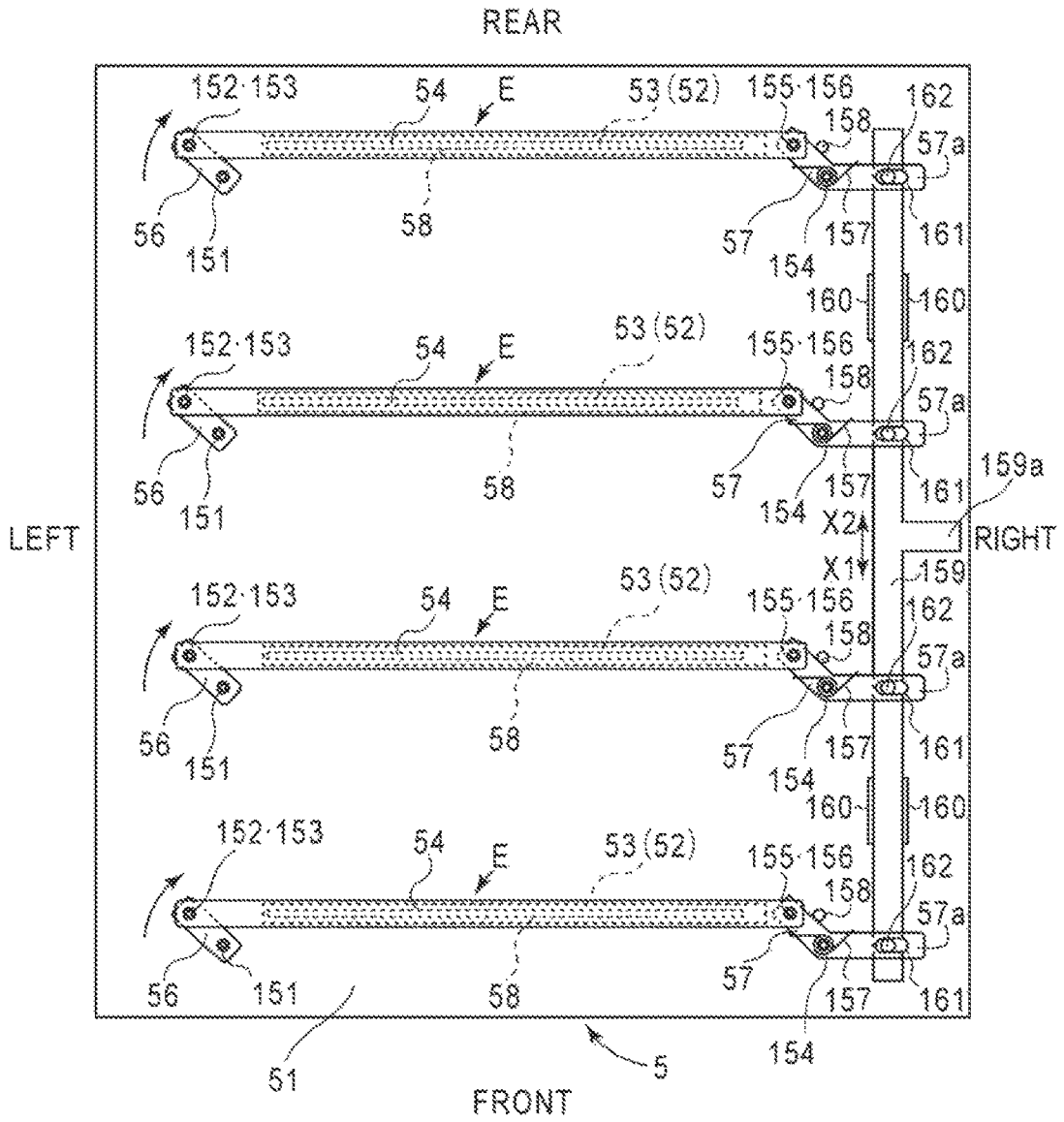
FIG. 15 is a top plan view of the optical unit when the shutter member is in the closing position in Embodiment 2.
Figure 16:
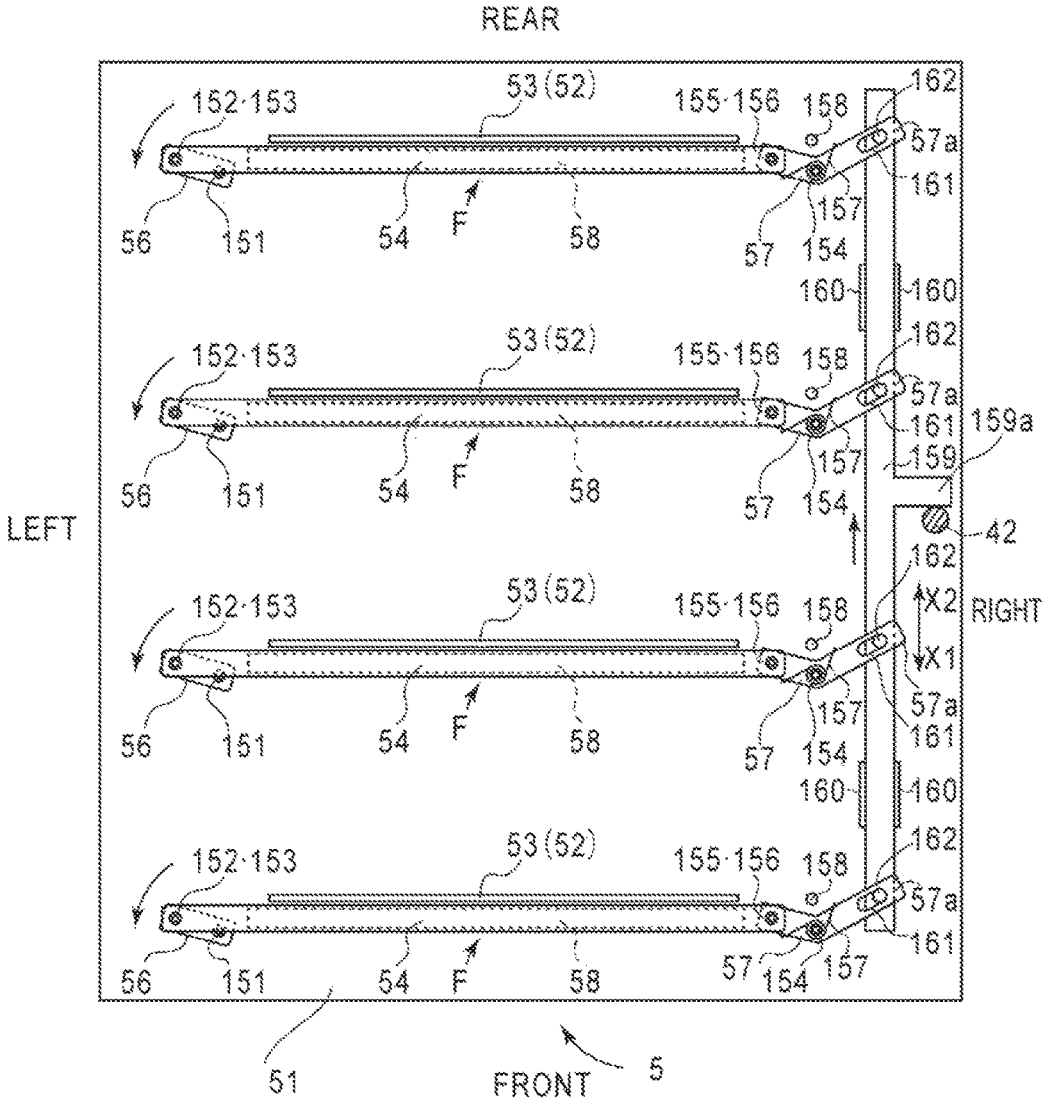
FIG. 16 is a top plan view of an optical unit when the shutter member is in the closing position.

FIG. 15 and FIG. 16 are top plan view of a laser scanner 5 used in this embodiment. FIG. 15 shows the state in which the shutter member 54 for opening and closing the exposure window 52 of the corresponding cartridge U is in a closing position E. FIG. 16 shows the state in which the shutter member 54 is in an open position F.

In this embodiment, as shown in FIG. 15 and FIG. 16, there is provided a slide plate 159 on the right side of the upper surface plate 51 of the scanner 5, the slide plate 159 being elongated in the front and rear direction and being slidable in the front and rear direction X1, X2 along a guiding member 160. The other arm portion 57*a* of the lever 57 which is a part of the parallelogram link mechanism in Embodiment 1 is rotatably mounted on the slide plate 159 by the engagement between an elongated hole 161 and a boss 162.

With this structure, by the movement of the slide plate 159 in the front and rear direction X1, X2, the four shutter members 54 are interrelatedly translated between the open positions F and the closing positions E, respectively.

In this embodiment, the slide plate 159 is provided with an arm portion (portion-to-be-engaged) 159*a*, and one projection (engaging portion) 42 actable on the arm portion 159*a* is provided at a right side of the bottom surface of the bottom plate 31 of the drawer member 30.

Embodiment 3

This embodiment is similar to Embodiment 1, but the opening and closing mechanism for the shutter member 54 is different from that shown in FIG. 12 through FIG. 13. In the description of this embodiment, the same reference numerals as in Embodiment 1 are assigned to the elements having the corresponding functions in this embodiment, and the detailed description thereof is omitted for simplicity.

Figure 17:
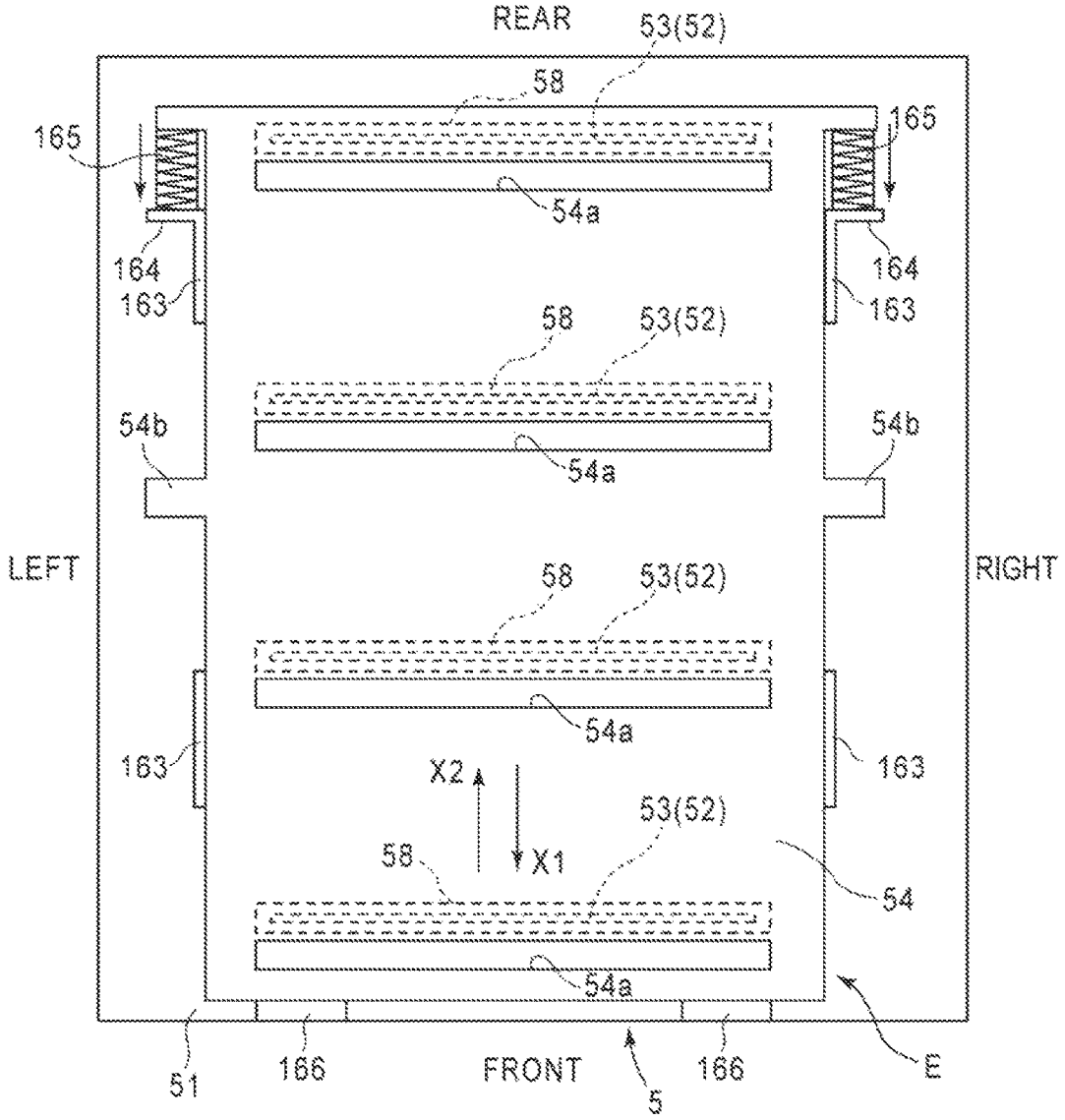
FIG. 17 is a top plan view of the optical unit when the shutter member is in the closing position in Embodiment 3.
Figure 18:
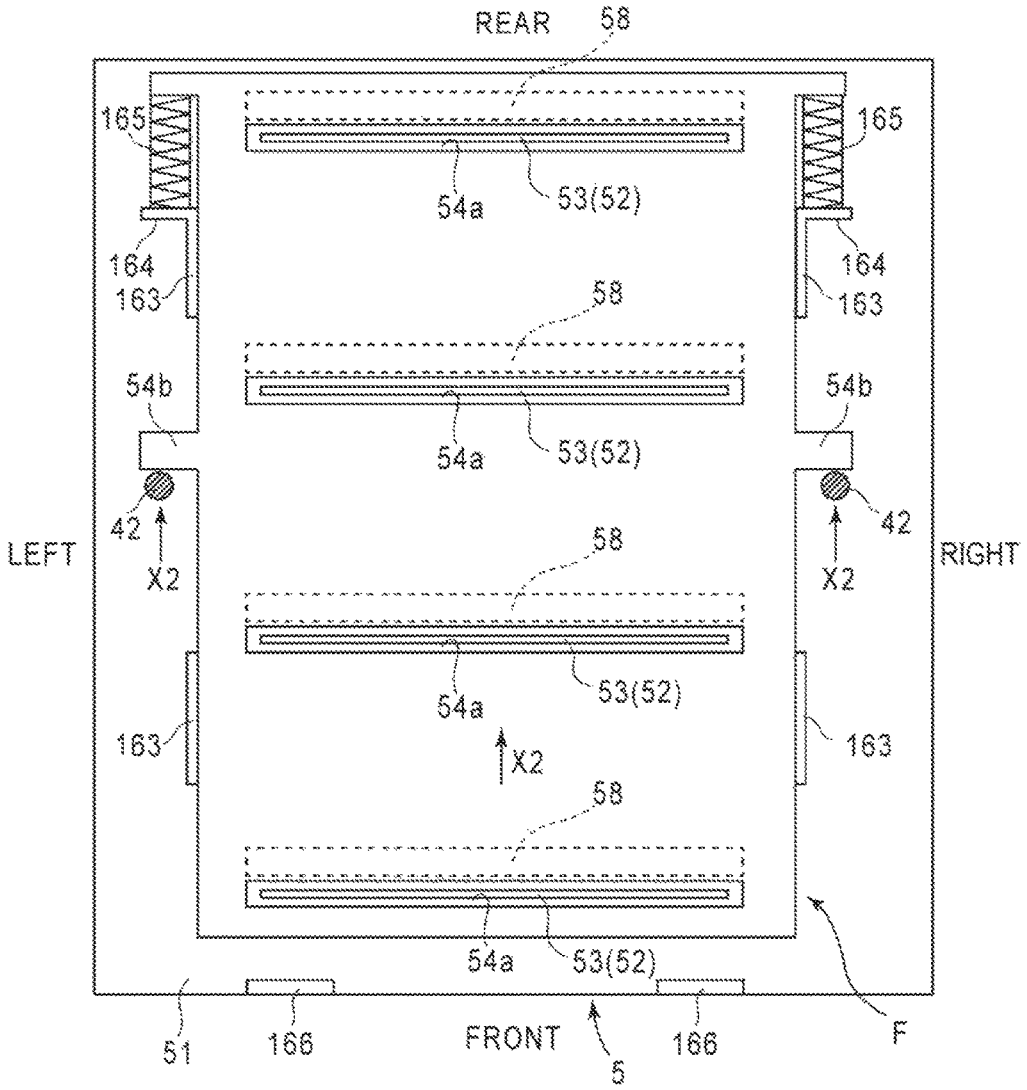
FIG. 18 is a top plan view of the optical unit when the shutter member is in the closing position.
Figure 20A:
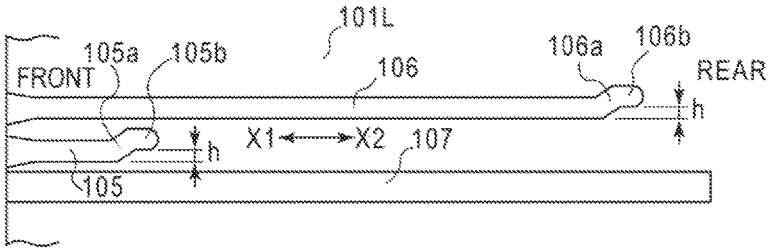
FIGS. 20(*a*), 20(*b*), 20(*c*) and 20(*d*) are illustrations of a moving structure for the drawer member.
Figure 20B:
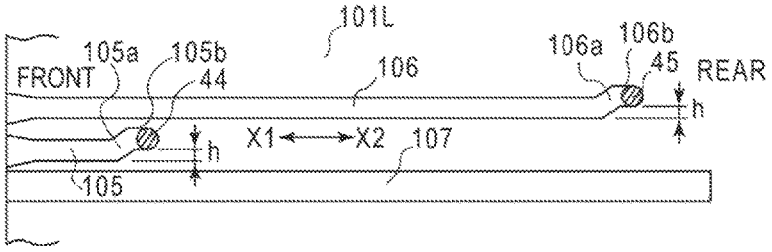
Figure 20C:
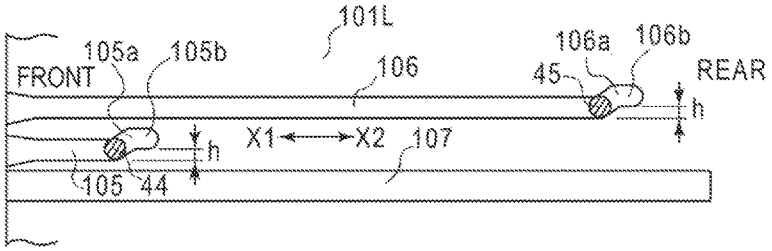
Figure 20D:
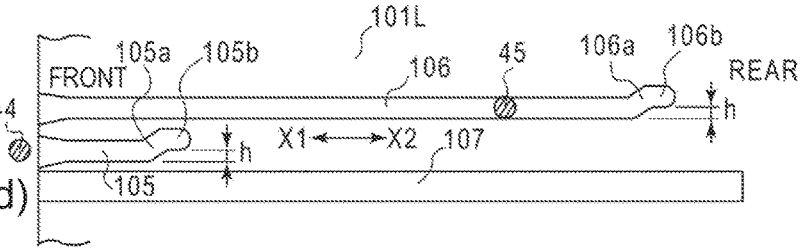

FIG. 17 and FIG. 18 are top plan view of a laser scanner 5 used in this embodiment. FIG. 17 shows the state in which the shutter member 54 for opening and closing the exposure window 52 of the corresponding cartridge U is in a closing position E. FIG. 18 shows the state in which the shutter member 54 is in an open position F.

As shown in FIG. 17 and FIG. 18, in this embodiment, the shutter member 54 is a common one rectangular flat plate member for the four exposure window 52. The shutter member 54 is provided with window shutter holes 54*a* in the form of slits elongated in the left-right direction, corresponding to the four exposure windows 52, respectively. The shutter member 54 is slidable on the upper surface plate 51 of the scanner 5 in the front and rear direction X1, X2 while being guided by the guiding member 163.

The shutter member 54 is normally urged in the frontward direction X1 by a stretching forces of left and right tension springs (urging member) 165 provided between the fixed member 164 on the upper surface plate 51 and the shutter member 54. In the free state of the shutter member 54, the shutter member 54 is in an advanced position E in which a leading side of the shutter member 54 is stopped by a front side stopper portion 166 of the upper surface plate 51.

In this state, the window shutter holes 54*a* of the shutter member 54 is deviated toward the front side from the position of the corresponding exposure window, and therefore, the exposure window 52 is covered by the plate portion of the shutter member 54. Therefore, the advanced position E of the shutter member 54 is a closing position for closing the optical path of the laser beam L to be projected onto the drum 1 from the scanner 5.

On each of the left and right sides of the shutter member 54, an arm portion 54*b* is provided. In the left and right sides of the bottom surface of the bottom plate 31 of the drawer member 30, there are provided downward projections 42 as engaging portions engageable with left and right arm portions (portions-to-be-engaged) 54*b* of the shutter member 54, respectively. As shown in FIG. 18, in the state that the drawer member 30 is in the inside position C of the main assembly 101, the two projections 42 are engaged (engaging operation) to the arm portions 54*b* of the shutter member 54, respectively.

In the state shown in FIG. 18, the shutter member 54 is retained in a retracted position F which is away from the closing position (advanced position) E shown in FIG. 17 by a predetermined distance in the backward direction X2, in which the tension spring 165 is stretched. In the state, the window shutter holes 54*a* of the shutter member 54 open the corresponding exposure windows 52. Therefore, the retracted position F of the shutter member 54 an open position for opening the optical path for the laser beam L to be projected onto the drum 1 from the scanner 5.

When the drawer member 30 is drawn outwardly from the inside position C in the frontward direction X1, the projections 42 are separated from the arm portions 54*b*, respectively (separating operation), the shutter member 54 is moved by the stretching force of the tension spring 165 To the closing position E shown in FIG. 17 from the open position F shown in FIG. 18.

In this embodiment, too, the bottom surface of the shutter member 54 is provided with the cleaning member 58 for the cover glass 53 of the corresponding exposure window 52. When the shutter member 54 moves between the open position F and the closing position E, the cleaning member 58 rubs the cover glass 53 of the corresponding exposure window 52 to remove the surface contamination of the cover glass 53.

In this embodiment, one shutter member 54 is common for the plurality of optical paths (four exposure windows). As compared with the structure shown in FIG. 12, the number of the shutter members is smaller, and therefore, the mechanism for opening and closing the shutter member (structure of the operating portion) can be simplified. On the other hand, the shutter member tends to be upsized, as compared with this structure (FIG. 12) using a plurality of shutter members.

Therefore, these structures are selectable in consideration of the structures of the image forming apparatuses. In this embodiment, one shutter member 54 is used to shut off the plurality of optical paths (four exposure windows 42) for the respective image forming portions (cartridges U). However, by using one shutter member for two or more optical paths of all of the optical paths (exposure windows 42), the opening and closing mechanism (mechanism of operating portion) for the shutter member is simplified correspondingly.

Embodiment 4

[Drawer Member Moving Structure]

The structure for moving the drawer member 30 relative to the main assembly 101 in this embodiment will be described. As shown in FIGS. 19(*a*) and 19(*b*), front side pin shafts 44 and rear side pin shafts 45 are provided in the front part on the outer surfaces of the right-hand frame portion 34 and the left-hand frame portion 35 of the drawer member 30, respectively, as members-to-be-guided. The front side pin shaft 44 is provided at a position lower than the rear side pin shaft 45.

On the other hand, as shown in FIG. 20(*a*), lower guide groove portions 105, upper guide groove portions 106 and guiding rails 107 are symmetrically provided on the inner surfaces of the left side frame 101L and the inner surface of the right-hand frame 101R of the main assembly 101, respectively. The lower guide groove portion 105 and the upper guide groove 106 are horizontal grooves extending in the front and rear direction X1, X2. The guiding rail 107 extends horizontally in the front and rear direction X1, X2 at a position lower than the lower guide groove portion 105. FIGS. 20(*a*), 20(*b*), 20(*c*) and 20(*d*) illustrate the left side frame 101L. The right-hand frame 101R is omitted for simplicity of description.

The drawer member 30 is disposed in the main assembly 101 with the left and right front side pin shafts 44 and rear side pin shafts 45 being engaged with the lower guide groove portions 105 and the upper guide grooves 106 of the left side frame 101L and the right-hand frame 101R, respectively. By doing so, the drawer member 30 is held for horizontal sliding movement in the front and rear direction X1, X2 between the left side frame 101L and the right-hand frame 101R.

In the rear end sides of the lower guide groove portion 105 and the upper guide groove 106, guide groove terminal portions 105*b* and 106*b* are continuously extended through inclination guide groove portions 105*a* and 106*a*, at positions predetermined distance higher than the guide groove portions 105 and 106. The lengths of the guide groove terminal portions 105*b* and 106*b* measured in the front and rear direction is substantially as small as the diameter of the front side pin shaft 44 and the rear side pin shaft 45.

Figure 21:
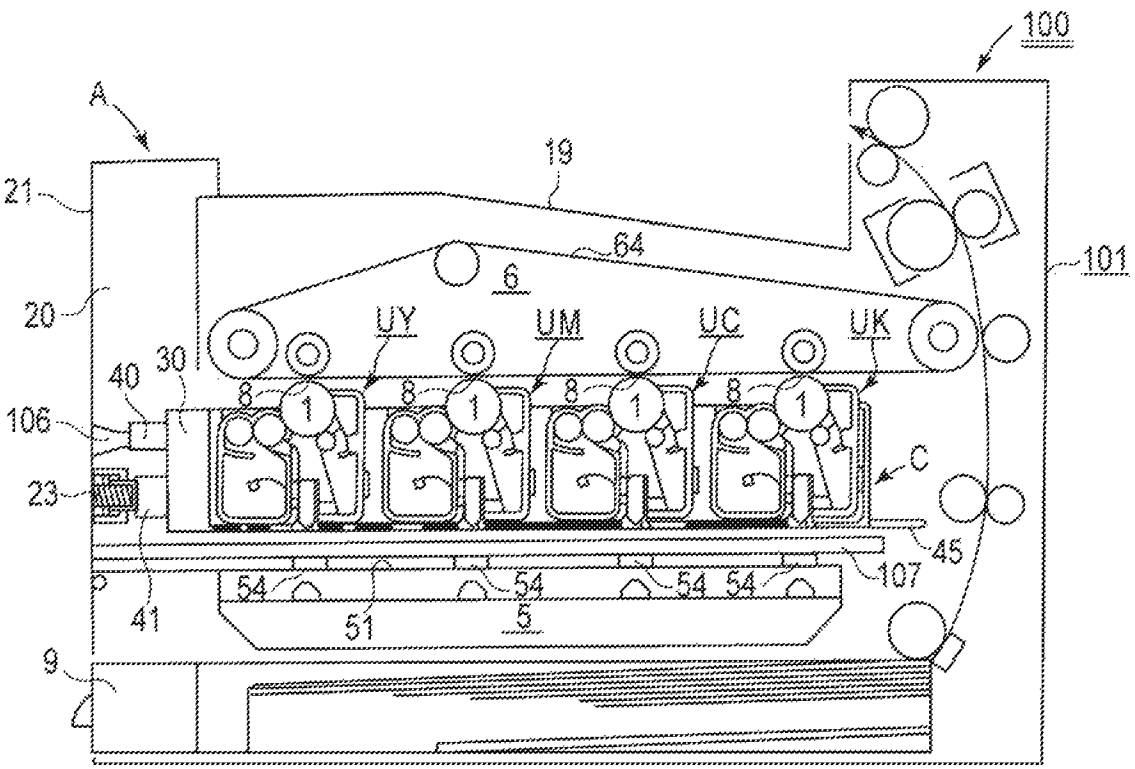
FIG. 21 is a longitudinal left side schematic view of the image forming apparatus.

1) FIG. 20(*b*) shows the positions of the front side pin shaft 44 and the rear side pin shaft 45 in the lower guide groove portion 105 and the upper guide groove 106, when the drawer member 30 is in the operative inside position C in the main assembly 101 as shown in FIG. 21. The front side pin shaft 44 and the rear side pin shaft 45 are in the guide groove terminal portions 105*b* and 106*b* of the lower guide groove portion 105 and the upper guide groove 106, and the drawer member 30 is stably held there.

In this state, the drawer member 30 is at a level higher than that when the front side pin shaft 44 and the rear side pin shaft 45 are in the lower guide groove portion 105 and the upper guide groove 106 by height h. As shown in FIG. 21, in this state, the upper surfaces of the drums 1 of the cartridges U supported on the drawer member 30 are contacted to the lower traveling portion of the belt 64 to provide primary transfer portions 8. The drawer member 30 is raised from the guiding rail 107 by height h.

2) FIG. 20(*c*) shows the positions of the front side pin shaft 44 and the rear side pin shaft 45 at the time immediately after the drawer member 30 is drawn outwardly from the inside position C in the frontward direction X1.

In this state, the front side pin shaft 44 and the rear side pin shaft 45 obliquely lower from the guide groove terminal portions 105*b* and 106*b* along the inclination guide groove portions 105*a* and 106*a*. Then, as shown in FIG. 20(*c*), the front side pin shaft 44 and the rear side pin shaft 45 moved to the connecting portions between the inclination guide groove portions 105*a* and 106*a* and the lower guide groove portion 105 and upper guide groove 106.

Figure 22:
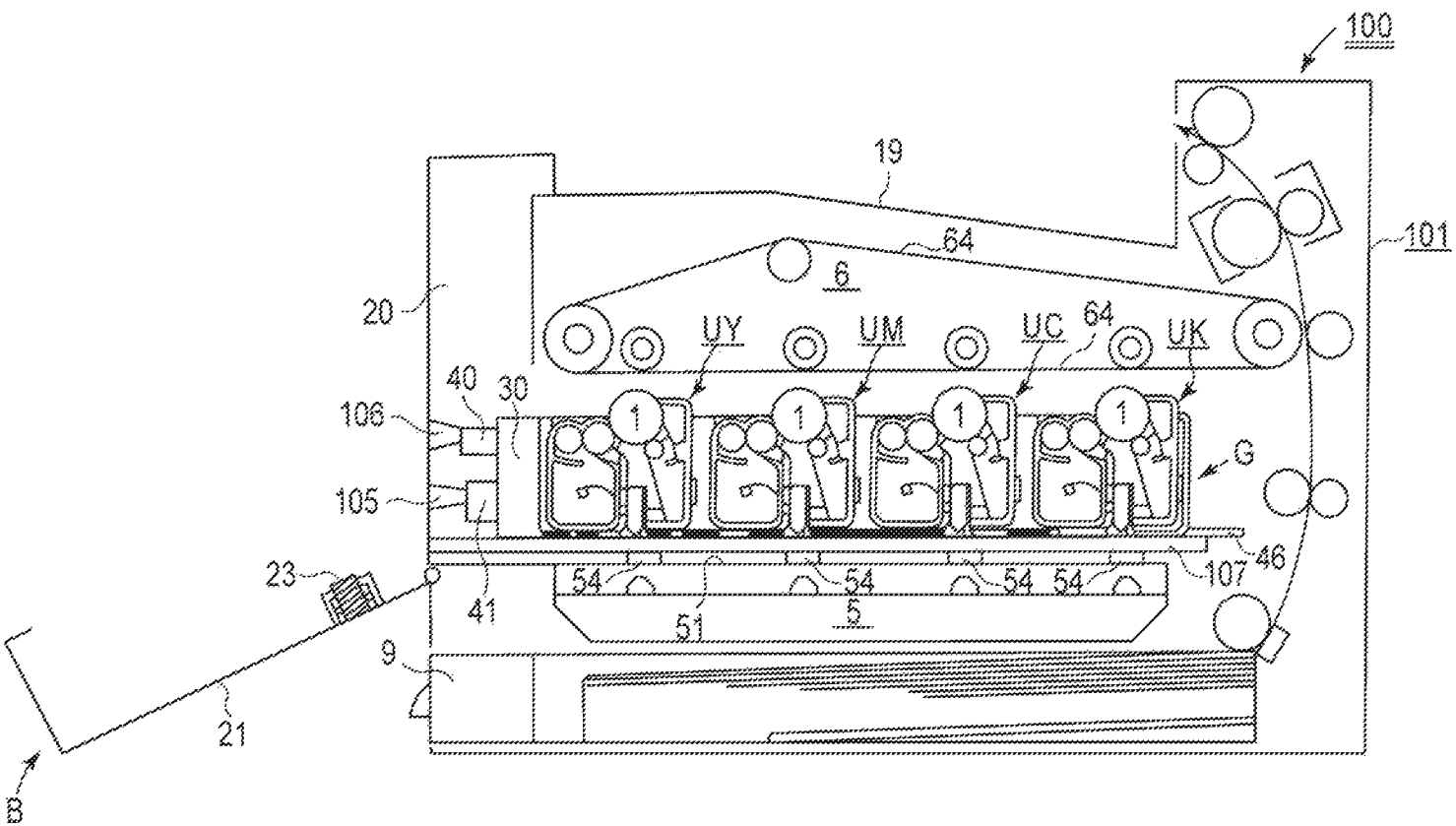
FIG. 22 is a longitudinal left side schematic view of the image forming apparatus when the front door is in the open position, and the drawer member is moved from an inside position to an inside transitional position.

In this state, the drawer member 30 lowers by height h from the inside position C to an inside transitional position G in the main assembly 101, as shown in FIG. 22, while keeping the horizontal position. Thus, in this embodiment, by the drawer member 30 lowering by the height h, the upper surfaces of the drums 1 of the cartridges U supported on the drawer member 30 are spaced from the belt 64 of the intermediary transfer member unit 6 fixed in the main assembly. The left and right portions of the bottom surface of the drawer member 30 placed in the inside transitional position G are supported by the guiding rails 107, respectively.

The inside transitional position G is such a position that the drums 1 of the cartridges U are spaced from the belt 64.

3) FIG. 20(*d*) shows the positions of the front side pin shaft 44 and the rear side pin shaft 45 in the lower guide groove portion 105 and the upper guide groove 106 during the movement of the drawer member 30 from the inside transitional position G in the frontward direction X1.

The front side pin shaft 44 and the rear side pin shaft 45 slide along the lower guide groove portion 105 and the upper guide groove 106 in the frontward direction X1. The left and right portions of the bottom surface of the drawer member 30 slides on the corresponding guiding rails 106. By this, the drawer member 30 is drawn out in the frontward direction X1 while keeping the horizontal attitude. The drums 1 of the cartridges U supported on the drawer member 30 are out of contact with the belt 64 of the unit 6, and therefore, the drums 1 do not rub the belt 64 in the drawing movement of the drawer member 30 toward the outside.

When the drawer member 30 is drawn outwardly, the front side pin shaft 44 is disengaged from the lower guide groove portion 105, but the rear side pin shaft 45 it still in engagement with the upper guide groove 106. The left and right portions of the bottom surface of the drawer member 30 and the left and right portions of the rear side extended plate portion 46 of the drawer member 30 are supported by the guiding rails 106. By this, the drawer member 30 can be drawn out while keeping the horizontal attitude stably.

Figure 23:
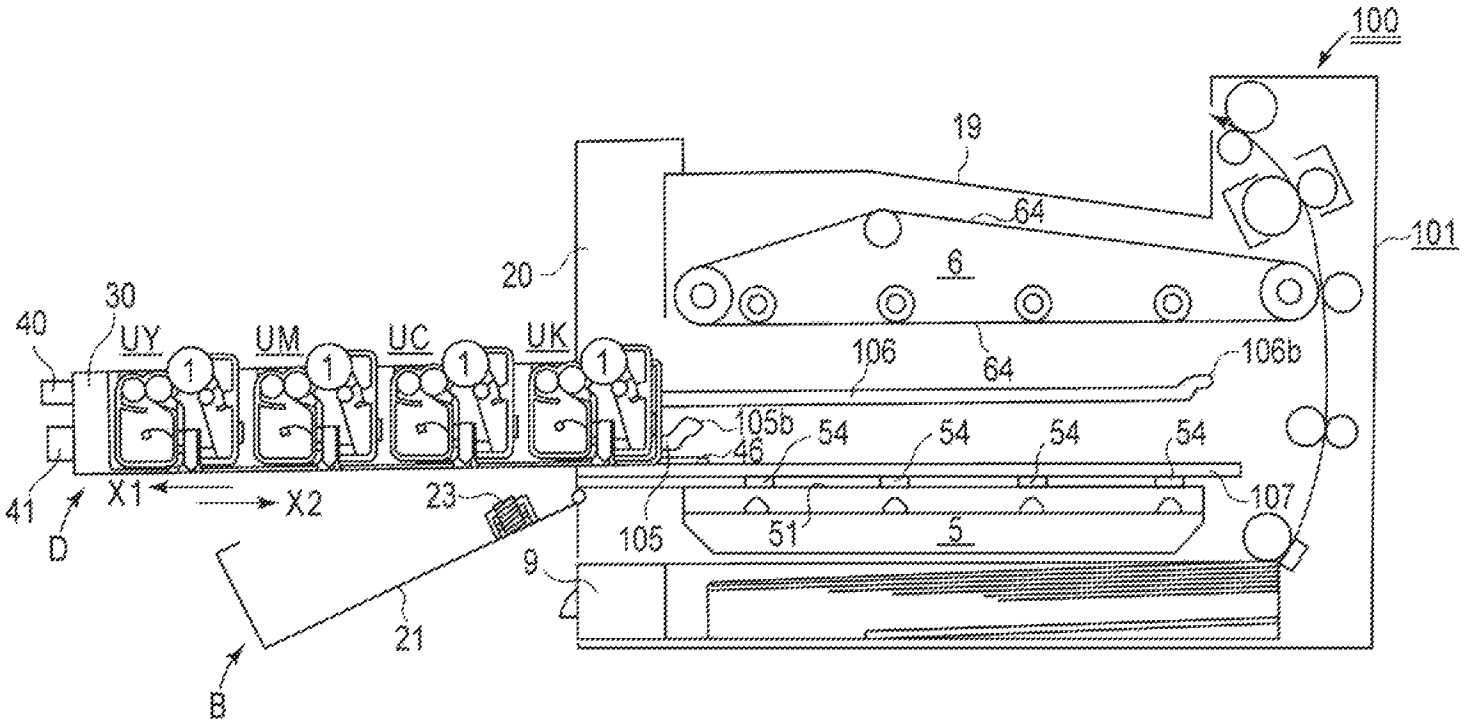
FIG. 23 is a longitudinal left side schematic view of the image forming apparatus when a drawer member is drawn out of the main assembly to an outside position.

4) As shown in FIG. 23, when the drawer member 30 is drawn out to the predetermined outside position D, the further movement of the drawer member 30 is stopped by the stopper member (unshown), and therefore, no further movement is prevented. In this state, too, the horizontal attitude of the drawer member 30 is stably maintained.

5) When the cartridge U or cartridges U are replaced in the outside position D of the drawer member 30, the drawer member 30 is pushed back in the backward direction X2 into the main assembly 101. That is, as shown in FIG. 22, drawer member 30 is moved into the main assembly 101 to the inside transitional position G. The upper surfaces of the drums 1 of the cartridges U supported on the drawer member 30 are out of contact with the belt 64 of the unit 6, and therefore, the drums 1 do not rub the belt 64 during the returning movement of the drawer member 30 by further pushing the drawer member 30 in the inside transitional position G in the backward direction X2, the front side pin shaft 44 and the rear side pin shaft 45 are raised obliquely along the inclination guide groove portions 105*a* and 106*a* (FIG. 20(*c*) to FIG. 20(*b*). By this, the drawer member 30 moves upwardly from the inside transitional position G to the inside position C by height h, while keeping the horizontal attitude.

In this manner, in this embodiment, the drawer member 30 displaces in the vertical direction by the height h during the movement of the drawer member 30 between the inside position C and the outside position D, by which the rubbing between the drums 1 and the belt 64 is prevented.

[Shutter Member and Opening and Closing Mechanism].

In this embodiment, in interrelation with the movement of the drawer member 30 from the inside position C to the inside transitional position G, the shutter members 54 of the laser scanner 5 are moved from the open position to the closing position. In addition, in interrelation with the movement of the drawer member 30 from the inside transitional position G to the inside position C, the shutter members 54 of the laser scanner 5 are moved from the closing position to the open position. This will be described in detail.

Figure 24A:
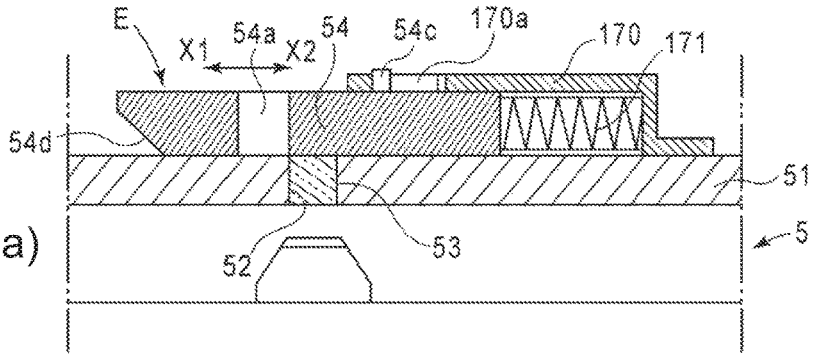
FIGS. 24(*a*), 24(*b*) and 24(*c*) illustrate the shutter member when an opening and closing structure therefor.
Figure 24B:
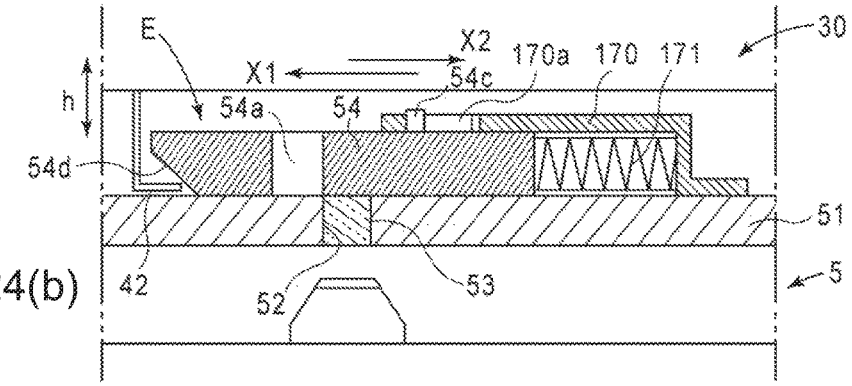
Figure 24C:
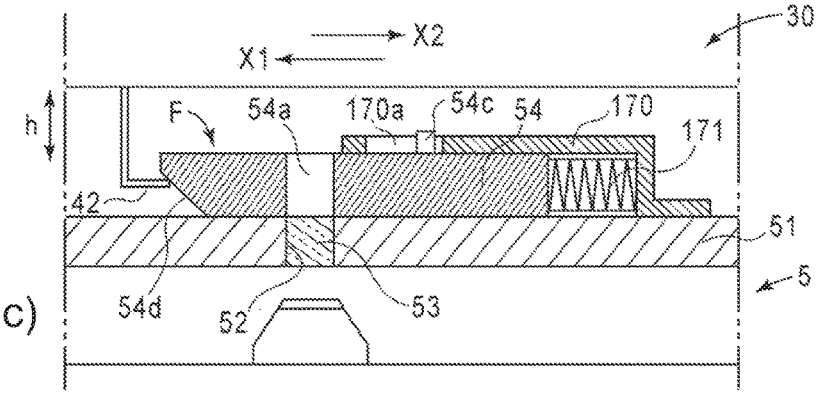

FIGS. 24(*a*), 24(*b*) and 24(*c*) are schematic views illustrating the shutter member 54 and the opening and closing structure in this embodiment. The four shutter members 54 of the laser scanner 5 have the same opening and closing structures, and therefore, the description will be made with respect to one shutter member 54.

The shutter member 54 includes a plate member elongated in the left-right direction and is provided with slit-like window shutter holes 54*a* corresponding to the slit-like exposure windows 52 formed in the upper surface plate 51 of the scanner 5 and extended in the left-right direction (perpendicular to the sheet of the drawing). The shutter member 54 is provided on the upper surface plate 51 which is confined by a pushing member 170 so as to be movable along the top surface of the upper surface plate 51 in the front and rear direction X1, X2. Designated by 54*c* is a longitudinal pin shaft provided a shutter member 54 and is engaged with a guiding hole 170*a* formed in the pushing member 170 and elongated in the front and rear direction.

The shutter member 54 is normally urged in the frontward direction X1 by a force applied by a compression spring 171 as an urging member provided between the pushing member 170 and the shutter member 54. As shown in FIG. 24(*a*), in the free state, the shutter member 54 is urged to the position E where the longitudinal pin shaft 54*c* abuts to the front side end portion of the elongated hole 170*a* in this retained there (advanced position).

In the state of the shutter member 54, the window shutter hole 54*a* is deviated from the exposure window 52 to the front side, and therefore, the exposure window is covered by the plate portion of the shutter member 54. The advanced position of the shutter member 54 is the closing position for closing the optical path of the laser beam L to be projected onto the drum 1 from the scanner 5.

The shutter member 54 is in the free state when the drawer member 30 is moved from the inside transitional position G to the outside position D, and therefore, the shutter member 54 is retained in the closing position E shown in FIG. 24(*a*).

The drawer member 30 is pushed back in the backward direction X2 from the outside position D into the main assembly 101 to the inside transitional position G. Then, as shown in FIG. 24(*b*), a hook portion 42 as an engaging portion provided on the bottom surface of the drawer member 30 brought into abutment to an obliquely-facing-down inclination cam surface (portion-to-be-engaged) 54*d* provided at the front side end portion of the shutter member 54.

By the drawer member 30 being further pushed from the inside transitional position G to the inside position C, the drawer member 30 rises by the height h during the movement, as described hereinbefore. By this, the shutter member 54 receives an urging force in the backward direction X2 by the contact (engaging operation) of the hook portion 42 to the inclination cam surface 54*d*, and the shutter member 54 retracts while contracting the compression spring 171.

When the drawer member 30 reaches the inside position C from the inside transitional position G, it is stopped, and the movement of the shutter member 54 in the backward direction X2 is also stopped. FIG. 24(*c*) shows the retracted position F where the shutter member 54 is stopped. In the retracted position F, the window shutter hole 54*a* faces to the exposure window. Therefore, the retracted position F of the shutter member 54 is the open position for opening the optical path for the laser beam L to be projected onto the drum 1 from the scanner 5.

On the other hand, when the drawer member 30 is drawn out of the inside position C in the frontward direction X1, the drawer member 30 lowers by the height h (separating operation of the hook portion 42) while the moving to the front during the movement. By this, the shutter member 54 is advanced from the open position F shown in FIG. 24(*c*) to the closing position E shown in FIG. 24(*b*) by the force applied by the compression spring 171.

In this manner, in this embodiment, in interrelation with the movement of the drawer member 30 from the inside position C to the inside transitional position G, the shutter member 54 is moved from the open position F to the closing position E. In addition, in interrelation with the movement of the drawer member 30 from the inside transitional position G to the inside position C, the shutter member 54 is moved from the closing position E to the open position F.

Embodiment 5

[Moving Structure for Drawer Member]

In this embodiment, the left side frame 101L and the right-hand frame 101R of the main assembly 101 are provided with respective guiding rails 107 horizontally elongated in the front and rear direction X1, X2 at symmetrical positions.

Figure 25A:
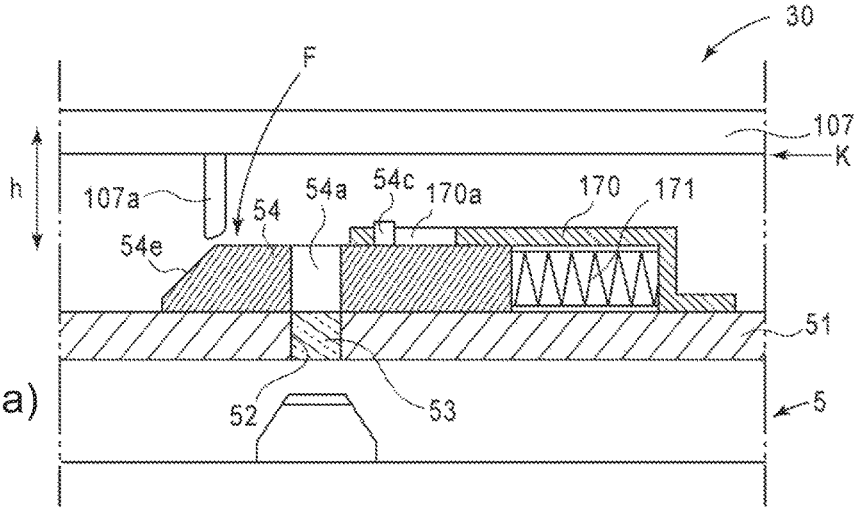
FIGS. 25(*a*) and 25(*b*) are illustrations of a shutter member when an opening and closing structure therefor in Embodiment 5.
Figure 25B:
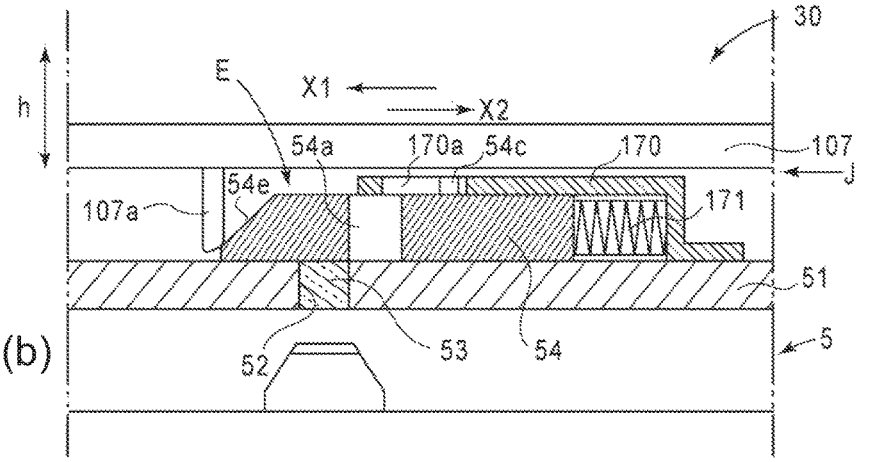
Figure 26:
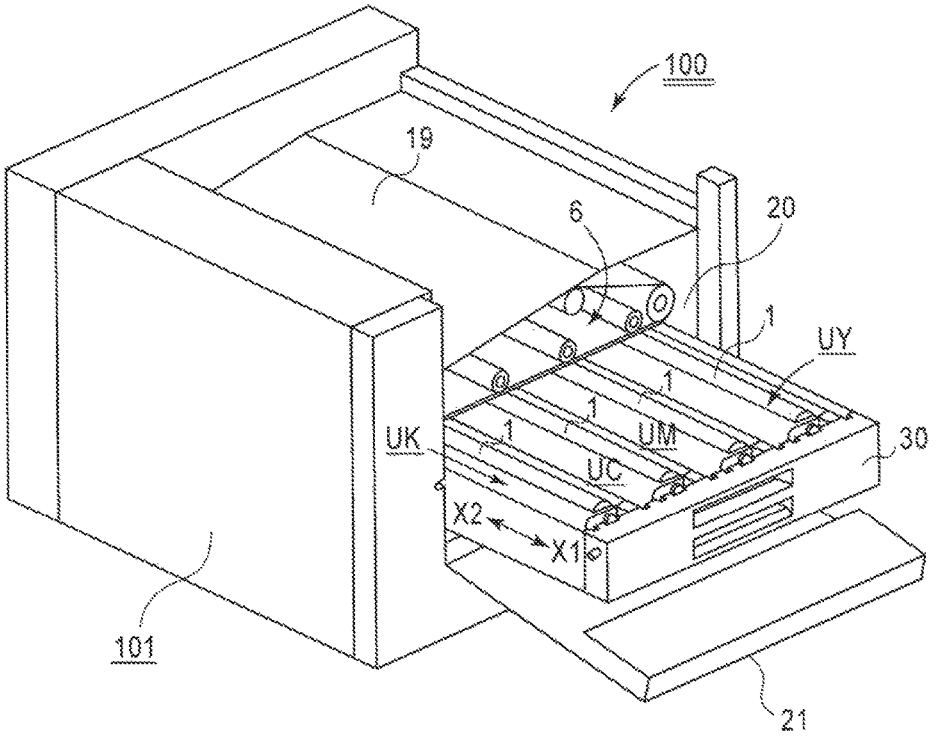
FIG. 26 is a perspective view of an example of an image forming apparatus in which the drawer member is movable in a direction parallel with a longitudinal direction of the drum relative to the main assembly.

The left and right guiding rails 107 are movable between a first position J (FIG. 25(*b*) and a second position K (FIG. 25(*a*) which is height h higher than the first position J by a horizontal movement. The left and right guiding rails 107 move from the second position K to the first position J in interrelation with an opening operation of the front door 21, and moves from the first position J to the second position K in interrelation with the closing operation of the front door 21, by an interrelating mechanism when the front door 21. The description of the interrelating mechanism is omitted for simplicity, but the interrelating mechanism disclosed in Japanese Laid-open Patent Application 2011-59730 is usable.

The drawer member 30 is supported by the left and right guiding rails 107. In the state that the front door 21 is open and the guiding rail 107 is in the first position J, the drawer member 30 is capable of the sliding horizontally along the guiding rails 107 between the inside transitional position G and the outside position D in the front and rear direction X1, X2.

in addition, the drawer member 30 moved to the inside transitional position G is further moved to the inside position C by being raised by the height h by the left and right guiding rails 107 moving from the first position J to the second position K in interrelation with the closing operation of the front door 21. The drawer member 30 placed in the inside position C is moved to the inside transitional position G while the left and right guiding rails 107 lowers from the second position K to the first position J by the height h in interrelation with the opening operation of the front door 21. Then, it is movable from the inside transitional position G to the outside position D.

[Shutter Member and Opening and Closing Mechanism]

In this embodiment, the shutter members 54 of the laser scanner 5 are moved from the open position F to the closing position E in interrelation with the movement of the guiding rails 107 from the second position K to the first position J when the drawer member 30 is moved from the inside position C to the inside transitional position G. The shutter members 54 are moved from the closing position E to the open position F in interrelation with the movement of the guiding rails 107 from the first position J to the second position K when the drawer member 30 is moved from the inside transitional position G to the inside position C. This will be described in detail.

FIGS. 25(*a*) and 25(*b*) are schematic views illustrating the shutter member 54 and the opening and closing structure in this embodiment. The four shutter members 54 of the laser scanner 5 have the same opening and closing structures, and therefore, the description will be made with respect to one shutter member 54. In the description of this embodiment, the same reference numerals as in Embodiment 3 (FIGS. 24(*a*), 24(*b*) and 24(*c*)) are assigned to the elements having the corresponding functions in this embodiment, and the detailed description thereof is omitted for simplicity.

FIG. 25(*a*) shows the state in which the drawer member 30 is in the inside position C after being raised by the height h by the left and right guiding rails 107 being moved from the first position J to the second position K in interrelation with the closing operation of the front door 21.

In this state, a hook portion 107*a* as an engaging portion provided on the guiding rail 107 is away from the shutter member 54 upwardly (separating operation). Therefore, the shutter member 54 is in the free state, that is, the shutter member 54 has been advanced to the position F where a vertical pin shaft (54*c*) abuts to the front side end portion of the guiding elongated hole 170*a* by the restoring force of the compression spring 171.

In this advanced position F, the window shutter hole 54*a* of the shutter portion 54 is faced to the exposure window 52. Therefore, the advanced position of the shutter member 54 is the open position for opening the optical path for the laser beam L projected onto the drum 1 from the scanner 5. In this embodiment, the compression spring 171 is an urging member for urging the shutter portion 54 in the direction from the closing position E toward the open position F.

FIG. 25(*b*) shows the state in which the drawer member 30 is in the inside transitional position G after being lowered by the height h by the left and right guiding rails 107 being moved from the second position K shown in FIG. 25(*a*) to the first position J in interrelation with the opening operation of the front door 21.

The hook portion 107*a* of the guiding rail 107 lowers together with the guiding rail 107 by the height h in contact with the inclination cam surface (engaged portion) 54*e* facing obliquely upward (engaging operation). Therefore, the shutter member 54 receives a component pressing force in the backward direction X2 by the contact of the hook portion 107*a* to the inclination cam surface 54*e*, so that the shutter member 54 moves to the retracted position E while contracting the compression spring 171.

In the retracted position E of the shutter portion 54, the window shutter hole 54*a* is deviated from the exposure window, so that the exposure window 52 is covered by the plate portion of the shutter member 54. Therefore, the retracted position E of the shutter member 54 is the closing position for closing the optical path for the laser beam L to be projected onto the drum 1 from the scanner 5.

In this manner, in this embodiment, the shutter member 54 is moved from the open position F to the closing position E with the movement of the guiding rail 107 from the second position K to the first position J at the time when the drawer member 30 is moved from the inside position C to the inside transitional position G. In addition, the shutter member 54 is moved from the closing position E to the open position F with the movement of the guiding rail 107 from the first position J to the second position K at the time when the drawer member 30 is moved from the inside transitional position G to the inside position C.

Other Embodiments (1) in the foregoing, the entirety of the image forming portion supported by the drawer member 30 is the cartridge. However, it will suffice if at least a part of the image forming portion is mountable to a dismountable from the drawer member 30, as a unit. In other words, the cartridge may include the drum 1 and at least one of process means actable on the drum 1.

For example, the drums 1, the charging rollers 2 and the cleaning devices 4 may be fixed in the drawer member 30, and the developing devices 3 is made mountable to and dismountable from the drawer member 30. On the contrary, the developing devices 3 may be fixed in the drawer member 30, and the drums 1, the charging rollers 2 and the cleaning devices 4 may be mountable to a dismountable from the drawer member 30 as a unit. Further alternatively, the drum 1, the charging roller 2 in the cleaning device 4 may be formed into a drum cartridge, and in the developing device 3 May be formed into a developing cartridge, in which the drum cartridge in the developing cartridge are individually mountable to and dismountable from the drawer member 30.

Thus, the cartridge may the one containing the image bearing member, may be the one containing a developing device for developing the latent image formed on the image bearing member with toner, and maybe the one containing the image bearing member and the developing device. The image bearing member is not limited to the drum type. It may be in the form of an endless belt.

(2) in the foregoing embodiments, the drawer member 30 carries a plurality of image forming portions U. More particularly, four image forming portions U are provided. However, the number of image forming portions carried on the drawer member 30 is not limited to four. The number is determined depending on the necessity. It may be one, two, three, five or more. Similarly, the numbers of the shutter members and the operating portions may be changed depending on the structures of the image forming apparatus.

(3) in the image forming apparatus 100 of the foregoing embodiments, the drawer member 30 supports the image forming portions U arranged in the direction X1, X2 of the movement of the drawer member 30, but the image forming portions U may be arranged in the direction crossing with the moving direction and the drawer member 30.

(4) in the image forming apparatus 100 of the foregoing embodiments, the drawer member 30 is moved between the inside and the outside of the main assembly 101 in a horizontal direction. However, the structure is not inevitable to the present invention.

For example, the drawer member 30 may be movable in an obliquely upward or downward direction crossing with the longitudinal direction (axial direction) of the drum 1, or in a vertical direction. The drawer member 30 may be movable relative to the main assembly 101 in the direction parallel with the longitudinal direction of the drum 1.

(5) the optical unit 5 is not limited to the laser scanner. It may be an exposure device including LED elements as the light source.

(6) the intermediary transfer member unit 6 of the image forming apparatus 100 of the foregoing embodiments may be replaced with a recording material feeding transferring device which conveys the sheet P. In this case, the developer image formed on the drum 1 is transferred directly onto the sheet P conveyed on the recording material feeding transferring device.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-043164 filed on Mar. 5, 2015, which is hereby incorporated by reference herein in its entirety.

What is claimed is:

1. An image forming apparatus for forming an image on a recording material, said apparatus comprising:

a main assembly provided with an opening;

a drawer member movable relative to said main assembly while supporting an image forming portion including at least an image bearing member for carrying a toner image, between an inside position which is inside said main assembly and in which an image forming operation is enabled and an outside position to which said drawer member is drawn out of said main assembly through said opening and in which a cartridge including at least a part of said image forming portion is mountable to and dismountable from said drawer member;

an optical unit provided in said main assembly and configured to project light onto said image bearing member and including a light projection opening and a transparent member covering the light projection opening;

a cleaning member provided in said main assembly and configured to clean a surface of the transparent member by moving relative to said optical unit;

an operating portion configured to move said cleaning member in a process of movement of said drawer member from the inside position to the outside position or a process of movement of said drawer member from the outside position to the inside position; and a guiding rail movable between a first position and a second position different from the first position while supporting said drawer member, said guiding rail permitting, when said guiding rail is in the first position, movement of said drawer member between an inside transitional position inside said main assembly and the outside position, and said guiding rail moving said drawer member from the inside transitional position to the inside position by being moved from first position to the second position.

2. The apparatus according to claim 1, wherein a movement distance of said drawer member before said cleaning member starts to move relative to said optical unit so as to clean the surface of the transparent member is smaller than one half of entire movement distance said drawer member from the inside position to the outside position.

3. The apparatus according to claim 1, further comprising an urging member configured to urge said cleaning member to move.

4. The apparatus according to claim 1, wherein said operating portion includes a portion-to-be-engaged on a side of said cleaning member and an engaging portion on a side of said drawer member.

5. The apparatus according to claim 1, wherein said drawer member is capable of supporting a plurality of such said image forming portions, and a plurality of such said cleaning members and a plurality of such said operating portions are provided, and said operating portions each include a portion-to-be-engaged on the side of said cleaning member and an engaging portion on the side of said drawer member, and wherein said engaging portions are disposed at different positions with respect to a direction perpendicular to a moving direction of said drawer member.

6. The apparatus according to claim 5, wherein said engaging portions disposed more downstream with respect to the moving direction are more outside on said drawer member with respect to the perpendicular direction.

7. The apparatus according to claim 1, wherein said drawer member is capable of supporting a plurality of such said image forming portions, and a plurality of such said cleaning members are provided in said main assembly, and wherein at a predetermined timing in the process of the movement of said drawer member from the inside position to the outside position, all of said cleaning members are moving.

8. The apparatus according to claim 1, wherein said drawer member displaces vertically in the process of movement between the inside position and the outside position.

9. The apparatus according to claim 1, wherein said drawer member supports a plurality of image forming portions are arranged along a moving direction of said drawer member or along a direction perpendicular to the moving direction.

10. The apparatus according to claim 9, wherein a plurality of said such operating portions are provided corresponding to said image forming portions.

11. The apparatus according to claim 1, wherein said drawer member is movable in a horizontal direction, obliquely upward direction, obliquely downward direction or vertical direction.

12. The apparatus according to claim 1, wherein said optical unit is disposed below said drawer member placed in the inside position.

13. The apparatus according to claim 1, wherein said cartridge includes said image bearing member.

14. The apparatus according to claim 1, wherein said cartridge includes a developing device configured to develop with toner a latent image formed on said image bearing member.

15. The apparatus according to claim 1, wherein said cartridge includes said image bearing member and a developing device configured to develop with toner a latent image formed on said image bearing member.

16. A drawer member usable with a main assembly of an image forming apparatus, the main assembly including an opening, an optical unit configured to project light onto an image bearing member for carrying a toner image and including a light projection opening and a transparent member covering the light projection opening, and a plurality of cleaning members provided in said main assembly and configured to clean a surface of the transparent member by moving relative to said optical unit, wherein a drawer member is movable relative to said main assembly while supporting an image forming portion including at least an image bearing member, between an inside position which is inside said main assembly and in which an image forming operation is enabled and an outside position to which said drawer member is drawn out of said main assembly through said opening and in which a cartridge including at least a part of said image forming portion is mountable to and dismountable from said drawer member, said drawer member comprising:

engaging portions engageable with a portions-to-be-engaged provided on each of said plurality of cleaning members, wherein said engaging portions move said plurality of cleaning members in a process of movement of said drawer member from the inside position to the outside position or in a process of movement of said drawer member from the outside position to the inside position, and wherein said engaging portions are disposed at different positions with respect to a direction perpendicular to a moving direction of said drawer member.

17. The drawer member according to claim 16, wherein said engaging portions disposed more downstream with respect to the moving direction are more outside on said drawer member with respect to the perpendicular direction.

18. The drawer member according to claim 16, wherein said drawer member is capable of supporting a plurality of such said image forming portions.

19. The drawer member according to claim 18, wherein said plurality of image forming portions are arranged along the moving direction of said drawer member.

20. An image forming apparatus for forming an image on a recording material, said apparatus comprising:

a main assembly provided with an opening;

a drawer member movable relative to said main assembly while supporting an image forming portion including at least an image bearing member for carrying a toner image, between an inside position which is inside said main assembly and in which an image forming operation is enabled and an outside position to which said drawer member is drawn out of said main assembly through said opening and in which a cartridge including at least a part of said image forming portion is mountable to and dismountable from said drawer member;

an optical unit provided in said main assembly and configured to project light onto said image bearing member and including a light projection opening and a transparent member covering the light projection opening;

a cleaning member provided in said main assembly and configured to clean a surface of the transparent member by moving relative to said optical unit; and an operating portion configured to move said cleaning member in a process of movement of said drawer member from the inside position to the outside position or a process of movement of said drawer member from the outside position to the inside position, wherein said drawer member is capable of supporting a plurality of such said image forming portions, and a plurality of such said cleaning members and a plurality of such said operating portions are provided, and said operating portions each include a portion-to-be-engaged on the side of said cleaning member and an engaging portion on the side of said drawer member, and wherein said engaging portions are disposed at different positions with respect to a direction perpendicular to a moving direction of said drawer member.

21. The apparatus according to claim 20, wherein a movement distance of said drawer member before said cleaning member starts to move relative to said optical unit so as to clean the surface of the transparent member is smaller than one half of entire movement distance said drawer member from the inside position to the outside position.

22. The apparatus according to claim 20, further comprising an urging member configured to urge said cleaning member to move.

23. The apparatus according to claim 20, wherein said engaging portions disposed more downstream with respect to the moving direction are more outside on said drawer member with respect to the perpendicular direction.

24. The apparatus according to claim 20, wherein at a predetermined timing in the process of the movement of said drawer member from the inside position to the outside position, all of said cleaning members are moving.

25. The apparatus according to claim 20, wherein said drawer member displaces vertically in the process of movement between the inside position and the outside position.

26. The apparatus according to claim 20, wherein said plurality of such said image forming portions are arranged along the moving direction of said drawer member or along a direction perpendicular to the moving direction.

27. The apparatus according to claim 20, wherein said drawer member is movable in a horizontal direction, obliquely upward direction, obliquely downward direction or vertical direction.

28. The apparatus according to claim 20, wherein said optical unit is disposed below said drawer member placed in the inside position.

29. The apparatus according to claim 20, wherein said cartridge includes said image bearing member.

30. The apparatus according to claim 20, wherein said cartridge includes a developing device configured to develop with toner a latent image formed on said image bearing member.

31. The apparatus according to claim 20, wherein said cartridge includes said image bearing member and a developing device configured to develop with toner a latent image formed on said image bearing member.

* * * * *